US007081052B2

(12) United States Patent
Greger et al.

(10) Patent No.: US 7,081,052 B2
(45) Date of Patent: Jul. 25, 2006

(54) FOLDABLE SWING HAVING ROTATABLE HANDLES

(75) Inventors: Jeff G. Greger, Lititz, PA (US); Alexander R. Therrien, West Chester, PA (US); Michael L. Longenecker, Ephrata, PA (US); Baku Kakuda, Reading, PA (US); Matthew J. Ransil, Stevens, PA (US)

(73) Assignee: Graco Children's Products Inc., Exton, PA (US)

( * ) Notice: Subject to any disclaimer, the term of this patent is extended or adjusted under 35 U.S.C. 154(b) by 0 days.

(21) Appl. No.: 10/804,184

(22) Filed: Mar. 19, 2004

(65) Prior Publication Data

US 2005/0059502 A1 Mar. 17, 2005

Related U.S. Application Data

(60) Provisional application No. 60/457,317, filed on Mar. 26, 2003.

(51) Int. Cl.
*A63G 9/00* (2006.01)

(52) U.S. Cl. ..... 472/118; 297/183.2

(58) Field of Classification Search ..... 472/118–125; 297/183.2, 183.1, 183.6; 5/93.1, 93.2, 99.1, 5/101, 102

See application file for complete search history.

(56) References Cited

U.S. PATENT DOCUMENTS

| | | | | |
|---|---|---|---|---|
| 3,731,342 | A | 5/1973 | Cousin | |
| 4,036,489 | A | 7/1977 | Potyondy | |
| 4,324,432 | A | 4/1982 | Eldon, III et al. | |
| 4,634,177 | A | 1/1987 | Meeker | |
| 4,697,845 | A | 10/1987 | Kamman | |
| 4,744,599 | A | 5/1988 | Jankowski et al. | |
| 4,948,120 | A * | 8/1990 | Krueger et al. | 297/274 |
| 5,326,327 | A | 7/1994 | Stephens et al. | |
| 5,378,196 | A | 1/1995 | Pinch et al. | |
| 5,419,747 | A | 5/1995 | Piaget et al. | |
| 5,531,656 | A | 7/1996 | Varghese | |
| 5,562,548 | A | 10/1996 | Pinch et al. | |
| 5,803,817 | A | 9/1998 | Stern | |
| 5,803,818 | A | 9/1998 | Tseng | |
| 5,846,136 | A | 12/1998 | Wu | |
| 5,951,108 | A | 9/1999 | Bauer et al. | |
| 5,975,631 | A | 11/1999 | Fair et al. | |
| 6,024,410 | A | 2/2000 | Yoshida | |
| 6,027,409 | A | 2/2000 | Favorito et al. | |
| 6,059,667 | A | 5/2000 | Pinch | |
| 6,319,138 | B1 | 11/2001 | Fair et al. | |
| 6,343,994 | B1 | 2/2002 | Clarke | |

(Continued)

FOREIGN PATENT DOCUMENTS

| | | |
|---|---|---|
| EP | 0 972 474 A1 | 1/2000 |

(Continued)

*Primary Examiner*—Kien Nguyen
(74) *Attorney, Agent, or Firm*—Lempia IP Group, LLC

(57) ABSTRACT

A child swing includes a swing frame and at least one swing handle rotationally coupled to the swing frame such that the swing handle may rotate about a handle rotational axis between at least two positions. The number of swing handles may be two, where each of the swing handles has a hand grip portion. The at least two positions may include a first position and a second position, the first position being substantially rotated about 180° relative to the second position. The swing frame may include first and second legs, each of the first and second legs including a length adjustment mechanism that allows the respective leg to be adjustable in length.

15 Claims, 25 Drawing Sheets

U.S. PATENT DOCUMENTS

| | | | |
|---|---|---|---|
| 6,464,594 | B1 | 10/2002 | Canna et al. |
| 6,520,862 | B1 | 2/2003 | Armbruster et al. |
| D477,719 | S | 7/2003 | Chaudeurge |
| 6,702,685 | B1 | 3/2004 | Mahlstedt et al. |
| 6,705,950 | B1 | 3/2004 | Wood et al. |
| 2004/0102252 | A1 | 5/2004 | Longenecker et al. |

FOREIGN PATENT DOCUMENTS

| | | | |
|---|---|---|---|
| GB | 326634 | A | 9/1929 |
| GB | 620350 | A | 3/1949 |
| GB | 936000 | A | 9/1963 |
| WO | WO 03/092841 | A1 | 11/2003 |

* cited by examiner

FOLDABLE SWING HAVING ROTATABLE HANDLES

RELATED APPLICATIONS

This application claims the benefit of U.S. Provisional Application No. 60/457,317, filed Mar. 26, 2003, which is incorporated by reference herein in its entirety.

FIELD OF THE INVENTION

This invention relates to a rotatable handle for a swing. More specifically, this invention relates to a rotatable handle for a foldable child swing.

BACKGROUND OF THE INVENTION

Various types of child or infant swings are known in the art. Typically, such swings include a support frame, hanger arms pivotably attached to the support frame, and a seat attached to the hanger arms.

It is also known to include a handle on the swing to allow a user to carry the swing. The handle is rigidly attached to the support frame, but the swing seat can sway back-and-forth as the swing is carried, which makes the swing somewhat awkward to move.

SUMMARY OF THE INVENTION

According to an aspect of the invention a swing is provided. The swing comprises a swing frame, and two swing handles rotationally coupled to the swing frame such that each swing handle may rotate about a respective handle rotational axis between at least two positions, each of the swing handles having a hand grip portion.

According to another aspect of the invention a swing is provided. The swing comprises a swing frame, and at least one handle rotationally coupled to the swing frame such that the at least one handle may rotate about a handle rotational axis between at least two positions, the at least two positions including a first position and a second position, the first position being substantially rotated about 180° relative to the second position.

According to yet another aspect of the invention, a swing is provided. The swing comprises a swing frame comprising a leg including a length adjustment mechanism that allows the leg to be adjustable in length. The swing also comprises a seat coupled to the swing frame to enable swinging motion of the seat relative to the swing frame.

According to still another aspect of the invention, a swing is provided. The swing comprises a swing frame including first and second legs, each of the first and second legs including a length adjustment mechanism that allows the respective leg to be adjustable in length, and a seat coupled to the swing frame to enable swinging motion of the seat relative to the swing frame.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate several embodiments of the invention and, together with the description, serve to explain the principles of the invention.

DETAILED DESCRIPTION OF THE PREFERRED EMBODIMENTS

Reference will now be made in detail to presently preferred embodiments of the invention, examples of which are illustrated in the accompanying drawings. An effort has been made to use the same reference numbers throughout the drawings to refer to the same or like parts.

Figure 1:
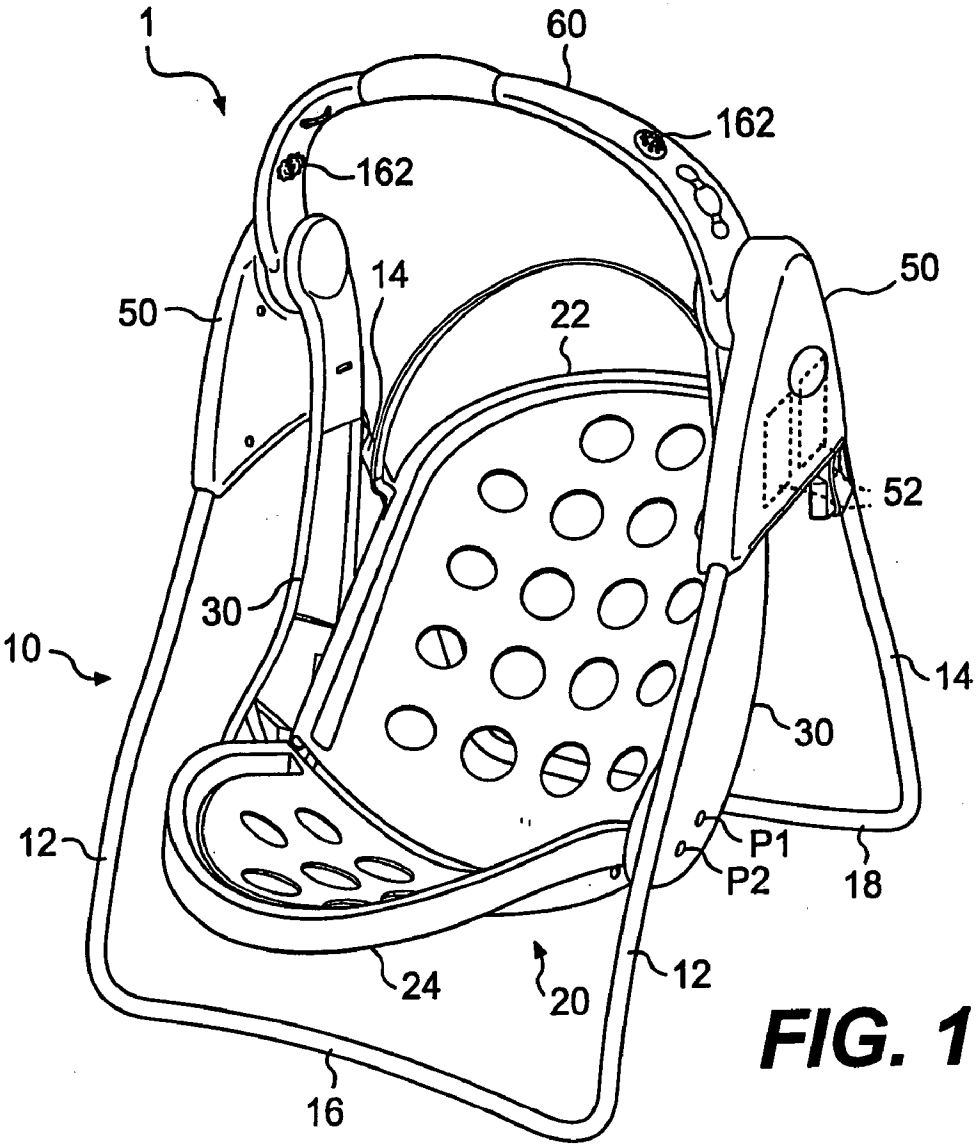
FIG. 1 is a front perspective view of a swing, where the swing handle is in an entertain position.

FIG. 1 illustrates a swing 1. The swing 1 has a foldable frame and a reclinable swing seat 20 that can be moved between a fold position, a first, upright in-use position, and a second, reclined in-use position. The swing 1 also includes a handle 60 that can be used to carry the swing. The handle 60 can be rotated between at least two positions. For example, in one swing, the handle 60 can be rotated between four positions, including: an open access position during which a child can be seated in the swing, a lift and lock position during which the swing can be carried by the handle, an entertain position during which a child seated in the swing can view lights and/or other play features of the handle, and a storage position during which the handle can be compactly stored when the frame is folded, such as disclosed in U.S. application Ser. No. 10/304,054, filed Nov. 26, 2002, which is incorporated by reference herein in its entirety. The number of positions may also be more than four.

The swing 1 generally includes a support frame 10, a seat 20 having a seat back 22 and a seat bottom 24, and pair of hanger arms 30 that connect the seat 20 to the support frame 10. The seat back 22 is pivotally connected to the hanger arms 30 at pivots P1, and the seat bottom 24 is pivotally connected to the hanger arms 30 at pivots P2.

The support frame 10 generally includes front legs 12, rear legs 14, a front cross member 16 extending between the front legs 12, a rear cross member 18 extending between the rear legs 14, and first and second housings 50. In the illustrated embodiment, the front legs 12 of the support frame 10 are fixedly connected to the respective housings 50, and the rear legs 14 of the support frame 10 are pivotally connected to the respective housings 50 to allow the swing 1 to fold, as will be explained below. Alternatively, the front legs can be pivotally connected to the respective housings, and the rear legs can be fixedly connected to the respective housings. In a further embodiment, both the front and rear legs can be pivotally connected to the housings. The fold swing operation will be described below in connection with FIGS. 7–9.

The support frame 10, in addition to supporting the support hangers 30 and ultimately the seat 20, also supports a swing handle 60, which is part of a swing handle assembly. The swing handle 60 is rotationally connected at either end to the housings 50 and to the hanger arms 30. The operation and structure of the swing handle assembly will be described below in connection with FIGS. 12–21.

The swing 1 also can include a power supply 52 within one of the housings 50 for supplying power to a motor to drive the motion of the swing 1 and/or for supplying power to the swing's electronic devices. The power supply 52 may comprise, for example, a battery holder for holding batteries.

As mentioned above, the swing seat 20 can be moved between a fold position, a first, upright in-use position, and a second, reclined in-use position. More specifically, the seat back 22 of the swing seat 20 is positionable in a first, upright in-use position, in a second, reclined in-use position in which the seat back 22 is adjusted rearward relative to its first in-use position, and in a fold position in which the seat back 22 is adjusted forward relative to its first, upright in-use position. While the frame 10 of the swing 1 is in-use, that is, erect, the seat back 22 can be positioned in its first and second in-use positions, and, when the frame 10 is folded for storage, the seat back 22 can be positioned in its fold position.

Figures 2, 3:
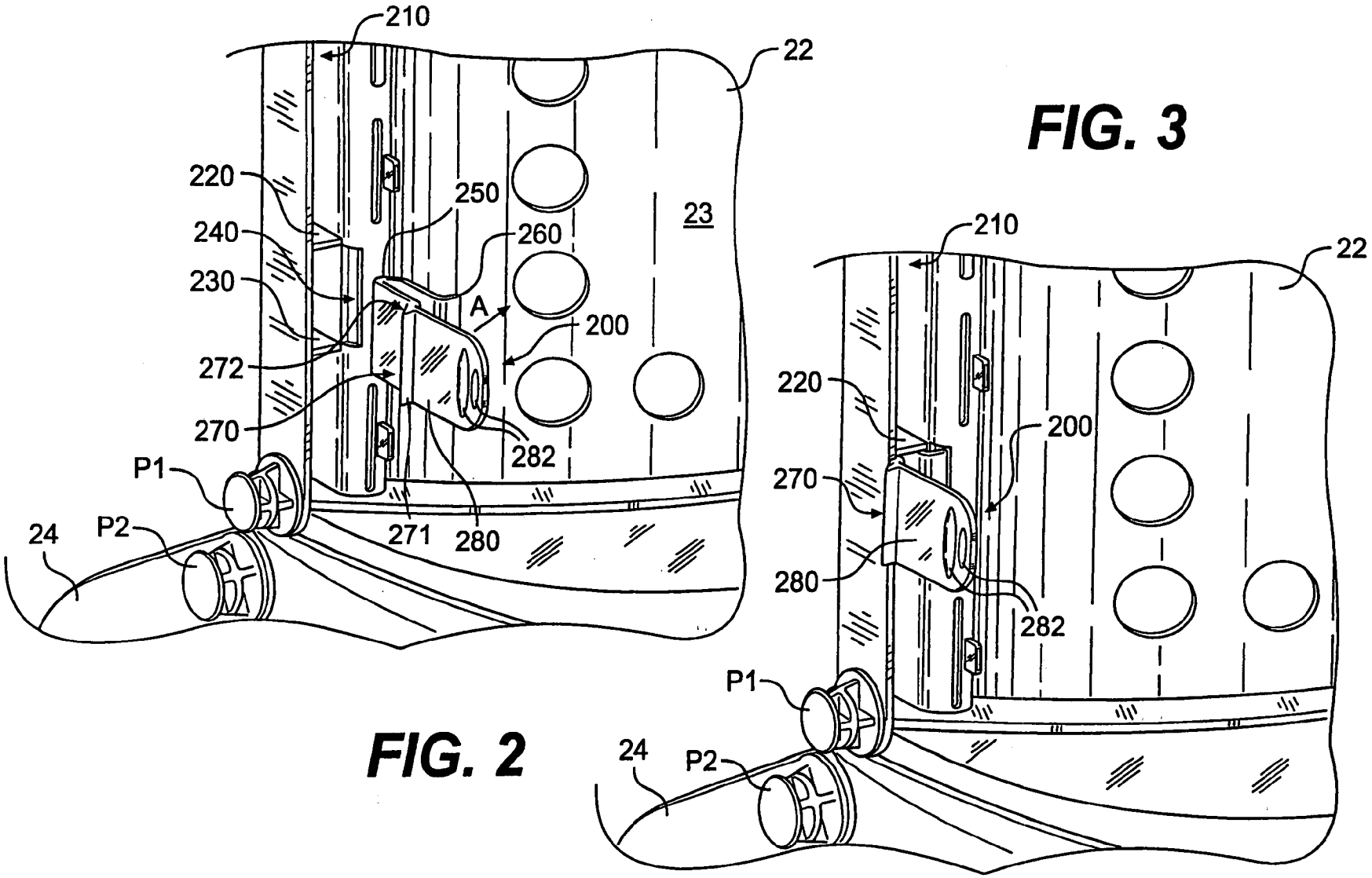
FIG. 2 is a rear perspective, exploded, detail view of the seat back and latch of the swing seat.
FIG. 3 is a rear perspective, detail view of the seat back and latch of the swing seat.

The seat recline mechanism will now be described in connection with FIGS. 2–6. The seat recline mechanism includes a latch 200 positioned on each side of the seat back 22 for engagement with the respective hanger arms 30. FIG. 2 is a detail view of the right side of the seat back 22 and the latch 200. Although the figures generally show the structural relationship between the seat 20 and the hanger arms 30 by reference to only one hanger arm 30, it will be understood that, in the illustrated embodiment, the seat-hanger arm relationship on the left and right sides of the swing are mirror images.

The seat back 22 includes a channel 210 molded along at least a portion of the perimeter of the rear surface 23 of the seat back 22. Upper and lower ribs 220, 230 are positioned in the channel 210 for capturing the latch 200 therebetween. The seat back 22 also includes a slot 240 adjacent the ribs 220, 230 for receipt of a portion of the latch 200. As seen in FIG. 2, the latch 200 is spaced from the pivot P1.

The latch 200 has a U-shaped segment 250 configured for insertion into the channel 210 between ribs 220, 230, a flange 260 at one end of the U-shaped segment 250, and a locking ridge 270 at the other end of the U-shaped segment 250. The flange 260 is configured for insertion into slot 240 in a snap fit to secure the latch to the seat back 22. FIG. 3 illustrates the latch 200 positioned in the channel 210 of the seat back 22, with flange 260 extending through slot 240. The locking ridge 270 is configured to engage latch-receiving members, such as ribs, on the hanger arms 30 to secure the seat back 22 in a selected in-use position.

The latch 200 also includes a segment 280 with finger bumps 282. A user can press on the finger bumps 282 to flex the latch 200 inwardly, about the U-shaped segment 250, in the direction of arrow A in FIG. 2 to disengage the latch from the hanger arms 30. This segment 280 may be visible to the user to facilitate positioning of the seat back to a desired in-use position.

Figure 4:
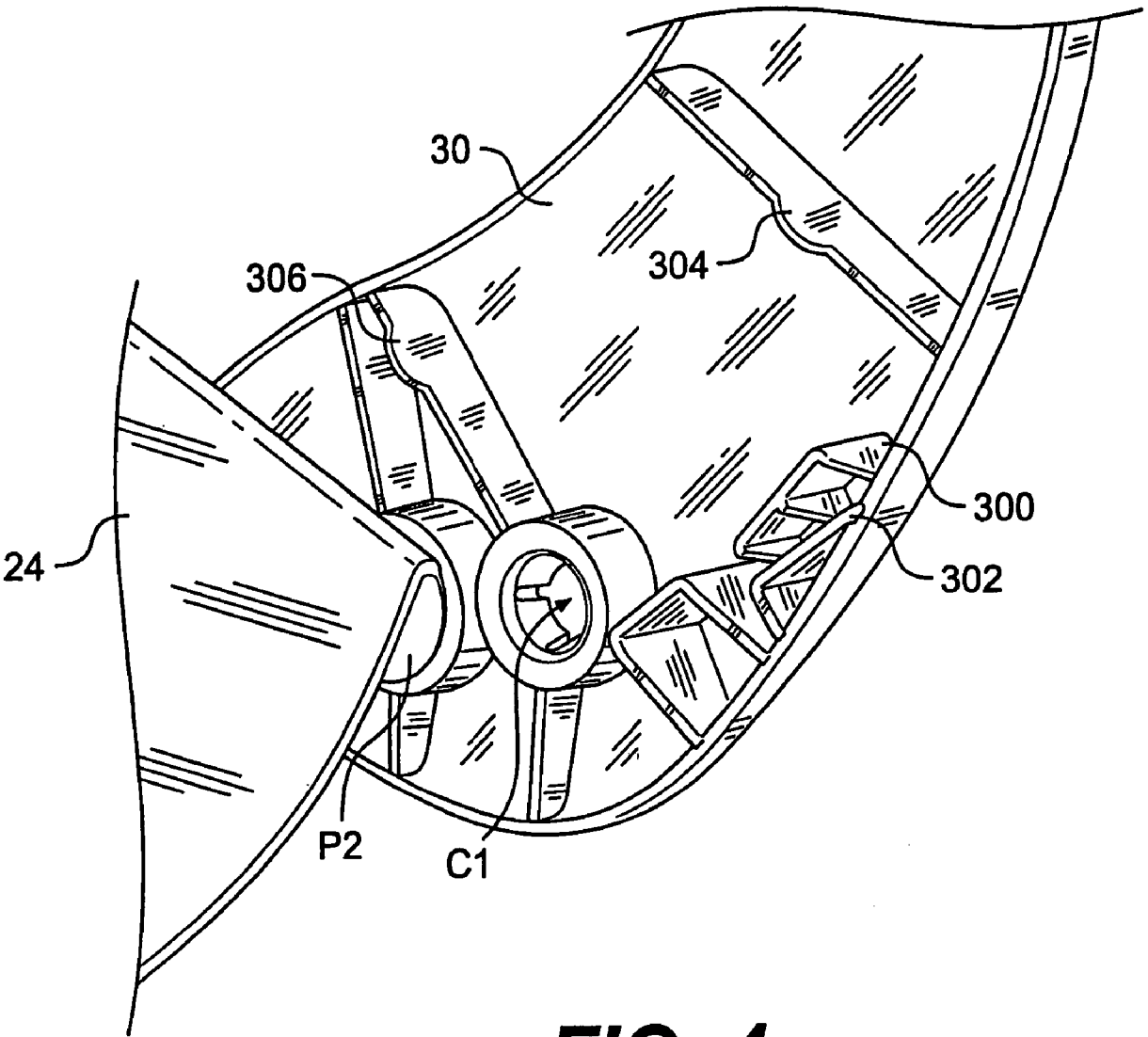
FIG. 4 is a rear perspective, detail view of the inner surface of a hanger arm of the swing.
Figure 6:
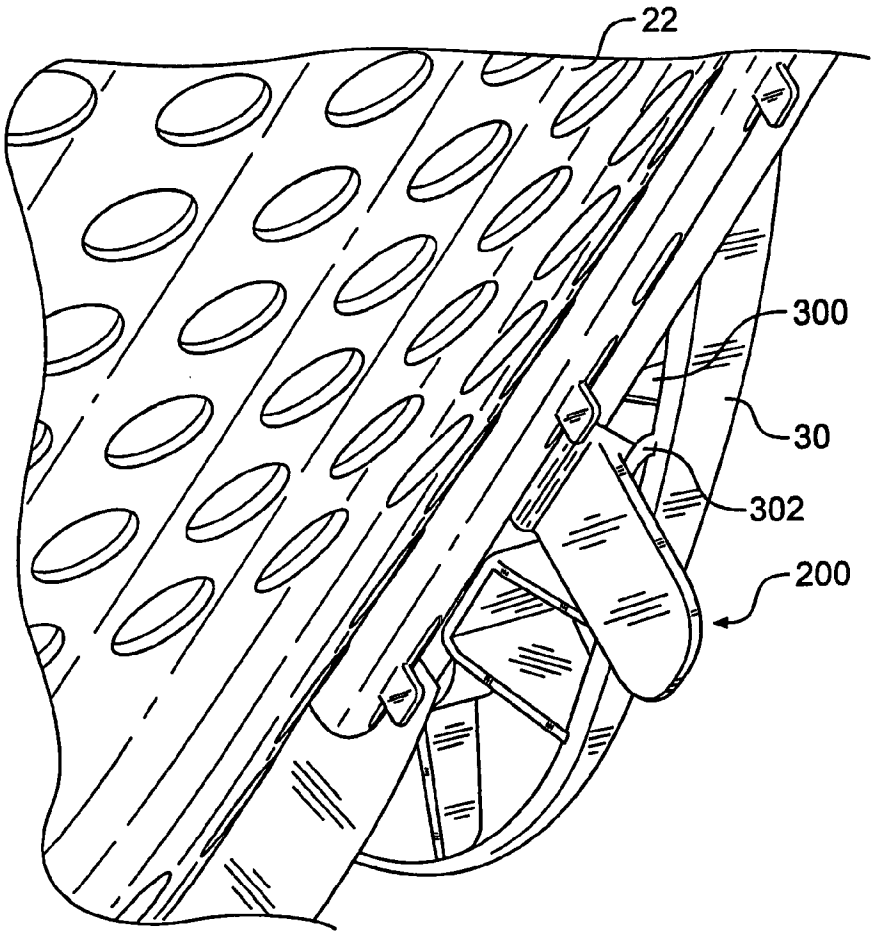
FIG. 6 is a rear perspective, detail view of the hanger arm and seat back, where the seat back is in a second in-use position.
Figure 5:
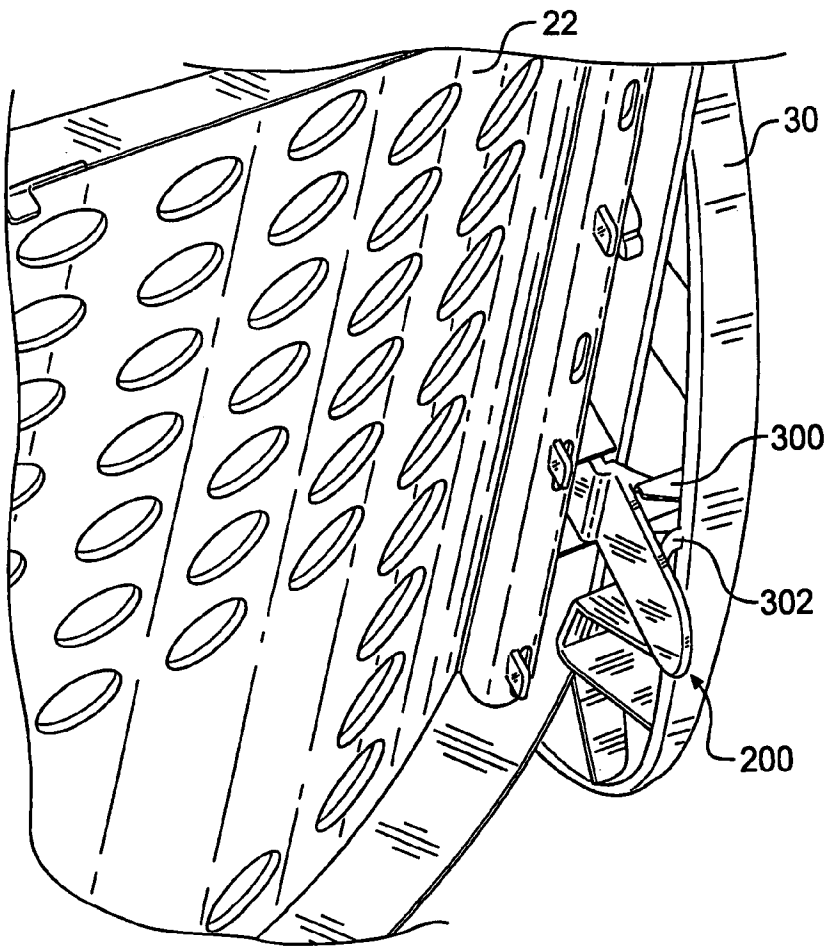
FIG. 5 is a rear perspective, detail view of a hanger arm and seat back, where the seat back is in a first in-use position.

FIG. 4 shows the inner surface of the left-side hanger arm 30, the right-side hanger arm 30 being a mirror image. The hanger arm 30 includes two through holes, one of which is labeled C1, to receive the pivot P1 of the seat back 22 and the pivot P2 of the seat bottom 24, respectively. In other embodiments, the seat back 22 and the seat bottom 24 can share a common pivot, and the hanger arm can include a single hub or single through hole to receive the pivot. The hanger arm 30 also includes first and second ribs 300, 302 corresponding to the first, upright in-use position and the second, reclined in-use position, respectively. To position the seat back 22 in the first, upright in-use position, the locking ridge 270 of each latch 200 is positioned against the first rib 300 of the respective hanger arm 30, as shown in FIG. 5. To position the seat back 22 in the second, reclined in-use position, the locking ridge 270 of each latch 200 is positioned against the second rib 302 of the respective hanger arm 30, as shown in FIG. 6.

As can be seen from FIG. 2, the locking ridge 270 has a flat surface 271 and an angled surface 272. Due to the configuration of the locking ridge 270, the user only needs to actuate the latch 200 to move the seat back 22 in a rearward direction, for example, from the upright in-use position to the reclined in-use position. The user need not actuate the latch 200 to move the seat back 22 in a forward direction, for example, from the reclined in-use position to the upright in-use position. When moving the seat back 22 forward from the reclined in-use position toward the upright in-use position, the user can grip the seat back 22 and pivot it forward, which causes the angled surface 272 to ride over the first rib 300. The latch 200 flexes inward until it passes the rib 300 and then restores to its at-rest configuration. At this point, the user can release the seat back 22 to allow the flat surface 271 to rest on the first rib 300. The seat back 22 can be moved from the upright in-use position to the fold position in the same manner, that is, by simply gripping the seat back 22 and pivoting it forward.

In addition to ribs 300, 302, each hanger arm 30 can include a rib 304 on its inner surface, forward of rib 302, to maintain the seat back 22 in the fold position. The rib 304 has a detent so that, when folded, the side of the seat back 22 comes into contact with the detent in a friction fit and is maintained in the fold position until the user pushes the seat back 22 rearward, away from the rib 304. Similarly, the hanger arms 30 each can include a rib 306 with a detent for engagement with a side of the seat bottom 24 to maintain the seat bottom 24 in a fold position when pivoted upwardly and rearwardly, toward the seat back 22.

Although only two in-use positions are shown in the figures, it will be understood that the hanger arms 30 can include additional ribs representative of additional in-use positions. Further, although the figures show the seat 20 suspended from a pair of hanger arms 30, a swing is envisioned having a single hanger arm to suspend the seat.

The latches 200 can be integrally molded as a unitary body with the seat back 22, or they can be fabricated separately from the seat back 22 and later releasably attached to the seat back 22 as shown in FIG. 2. When fabricated separately, the latches 200 can have a different color than the seat back 22 to make them more visible to the user. In addition, the latches 200 can be fabricated from any suitable material, including plastic (such as acetal), steel, and aluminum. When the latch 200 is fabricated from a relatively rigid material, such as a metal or metal alloy, as opposed to a flexible plastic, the latching force achieved by deformation and restoration of the plastic latch material can be accomplished by a spring appropriately located relative to the metal latch 200 and the channel 210.

Figure 7:
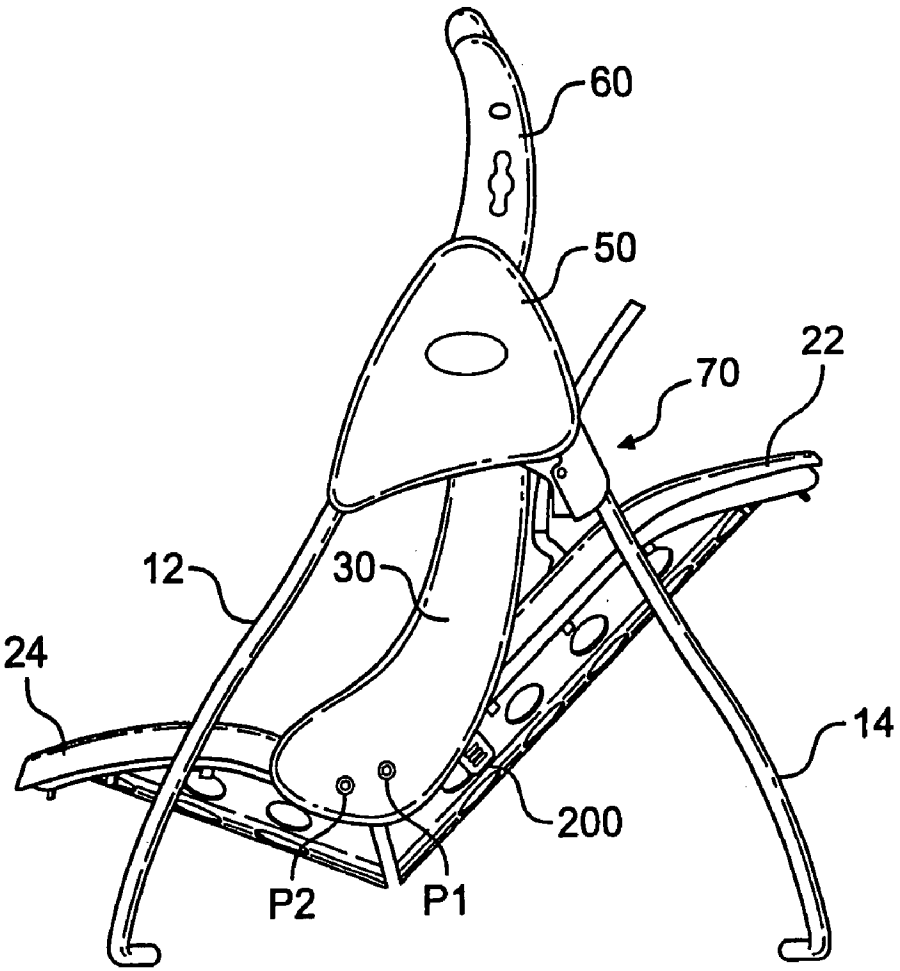
FIG. 7 is a side view of the swing in the first in-use position.
Figure 9:
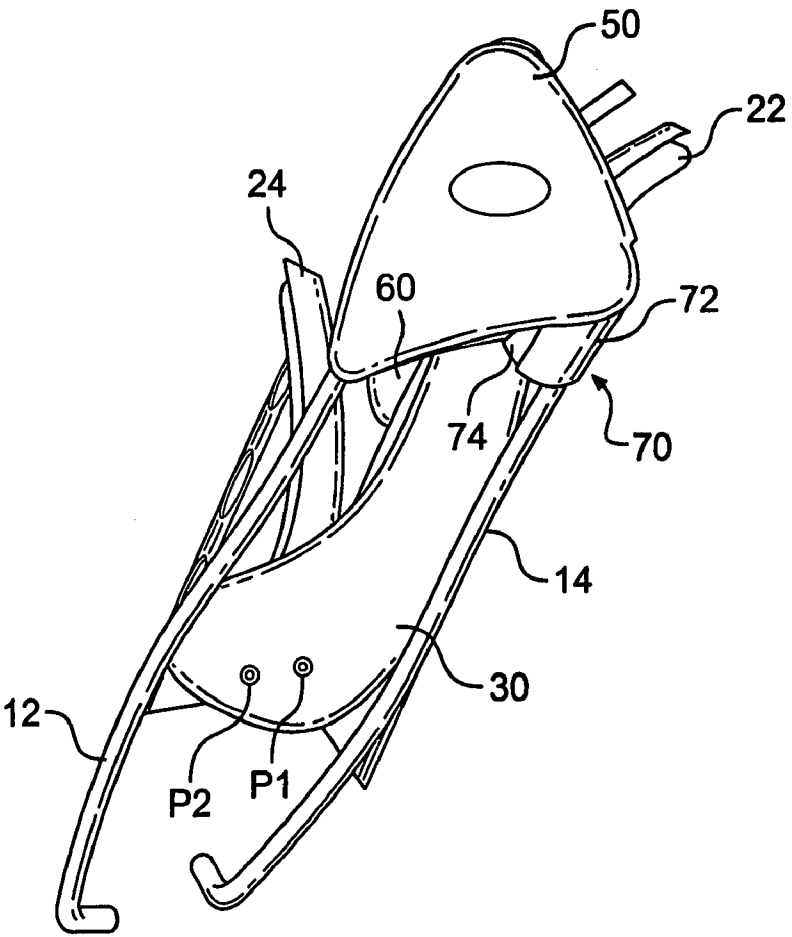
FIG. 9 is a side view of the swing in a fully folded position.
Figure 8:
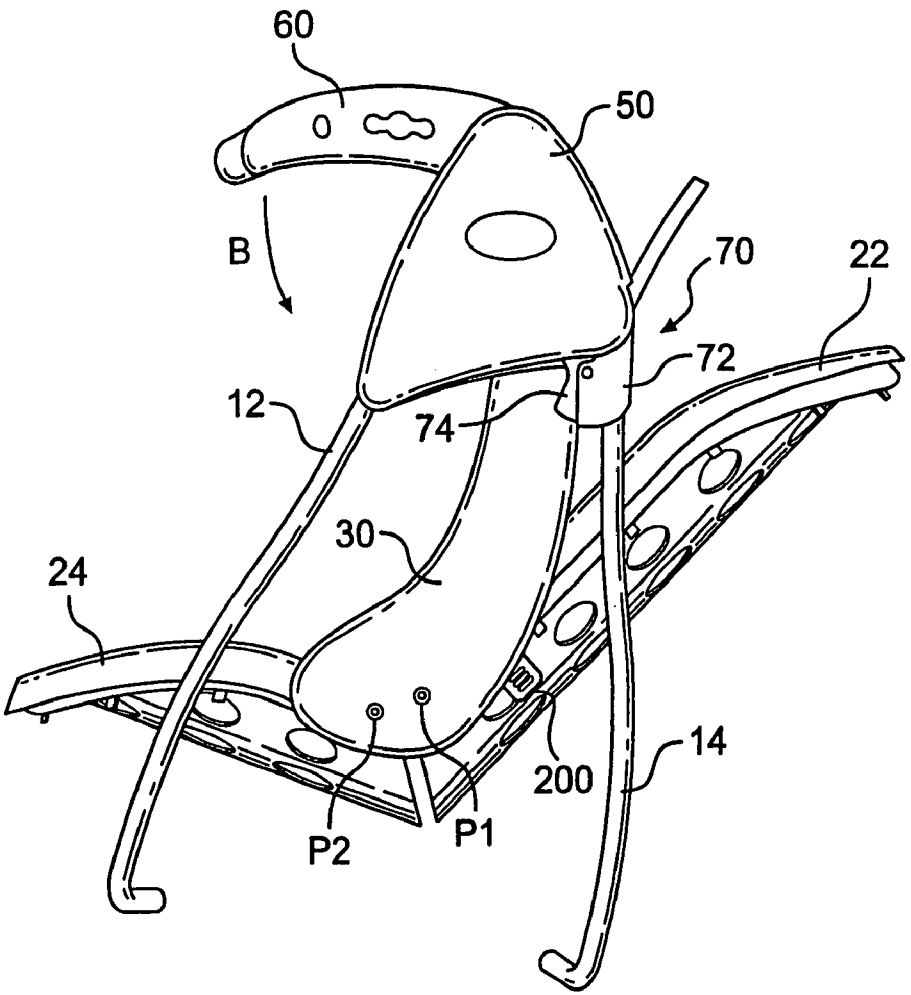
FIG. 8 is a side view of the swing in an intermediate fold position.

The swing fold operation will now be described in connection with FIGS. 7–9. FIG. 7 shows the swing in an in-use position, the seat back 22 in its first, reclined in-use position, and the swing handle 60 in its lift and lock position. A rear leg fold mechanism 70 is mounted to each rear leg 14 adjacent each housing 50. To fold the swing 1, the rear leg fold mechanisms 70 are actuated by the user so that the rear legs 14 can pivot relative to the housings 50 toward the front legs 12.

Figure 10:
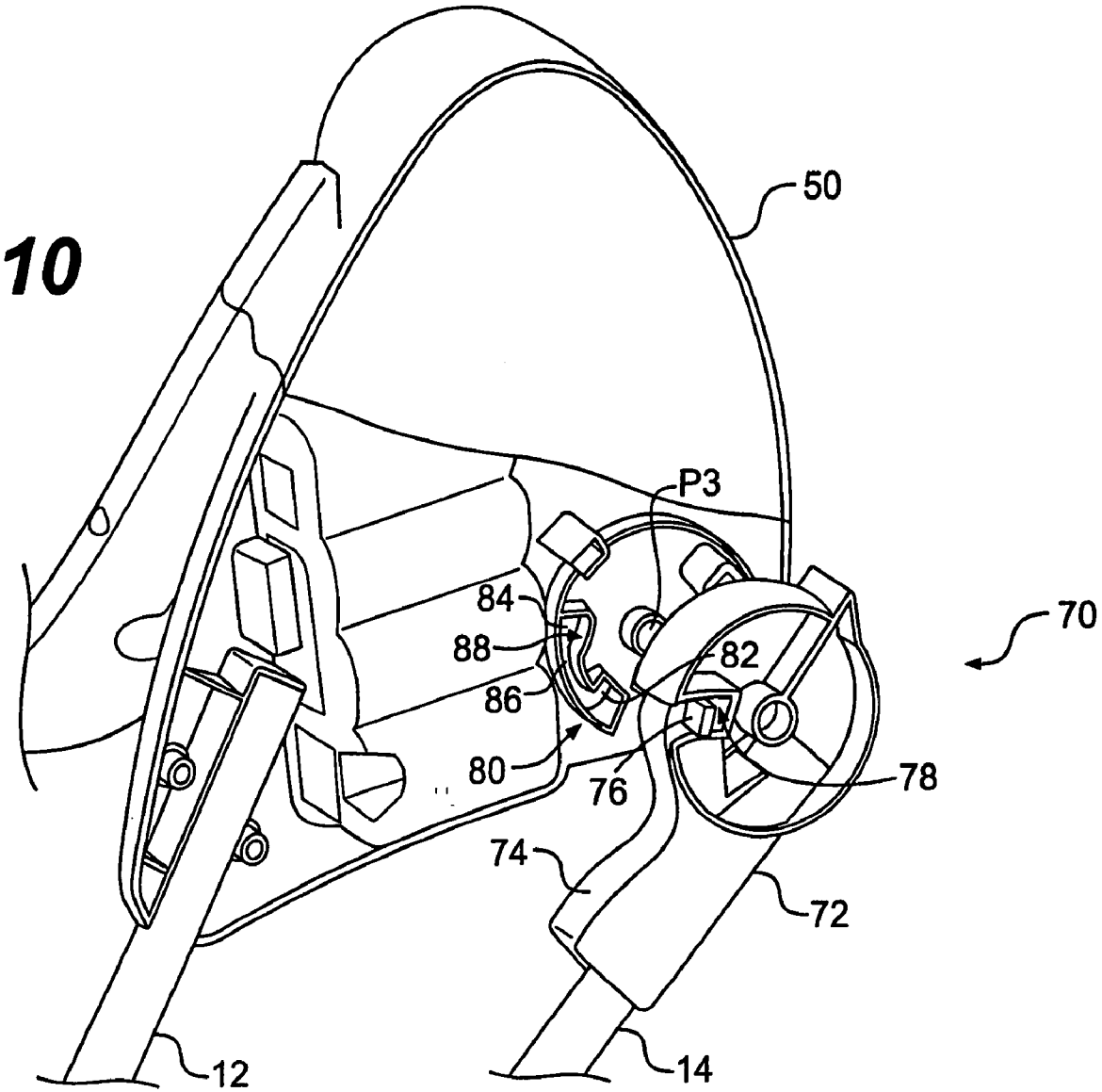
FIG. 10 is an exploded, detail view of the rear leg fold mechanism.
Figure 10A:
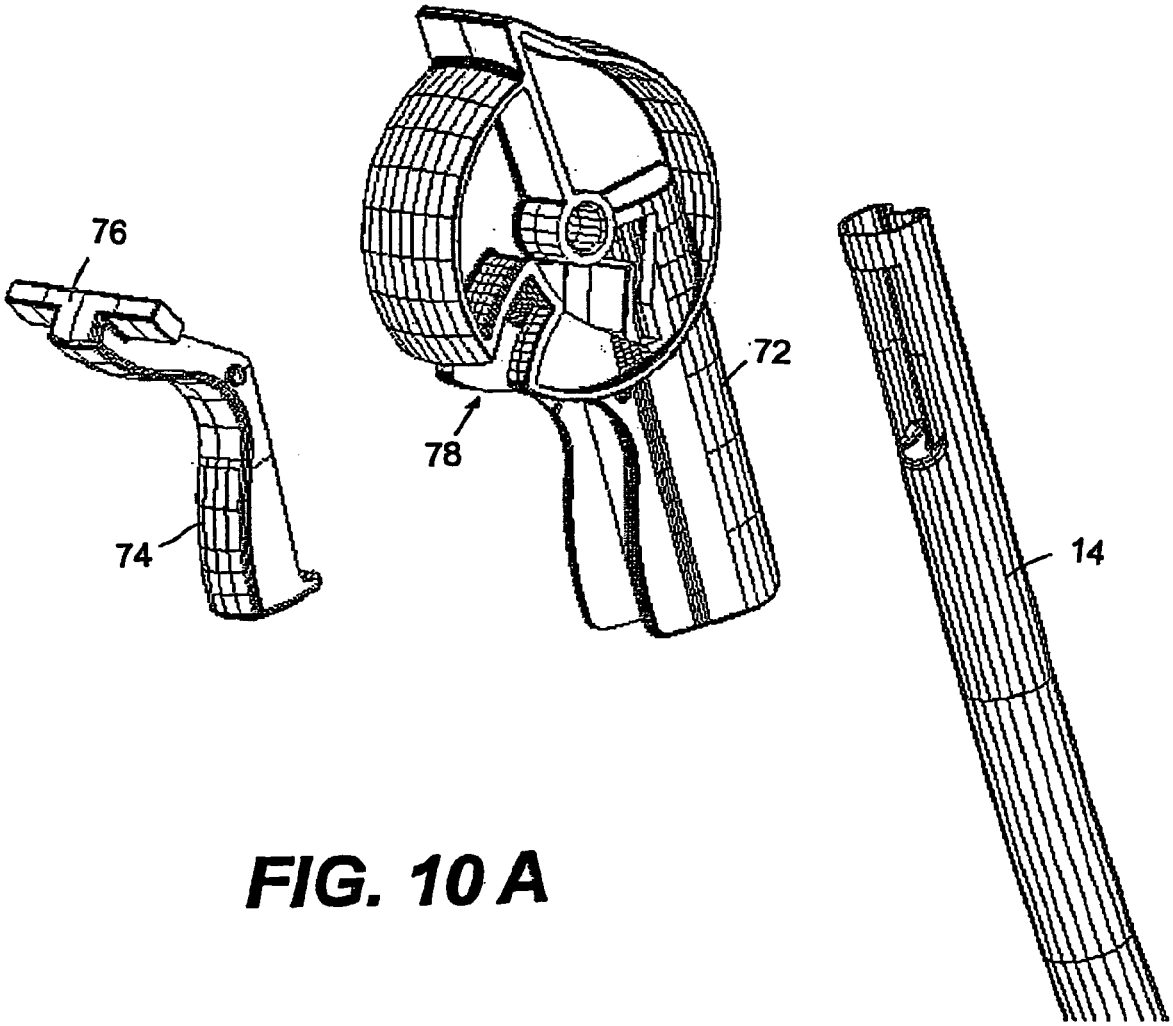
FIG. 10A is an exploded, perspective view of the leg socket member and the release lever of the rear leg fold mechanism.
Figure 11A:
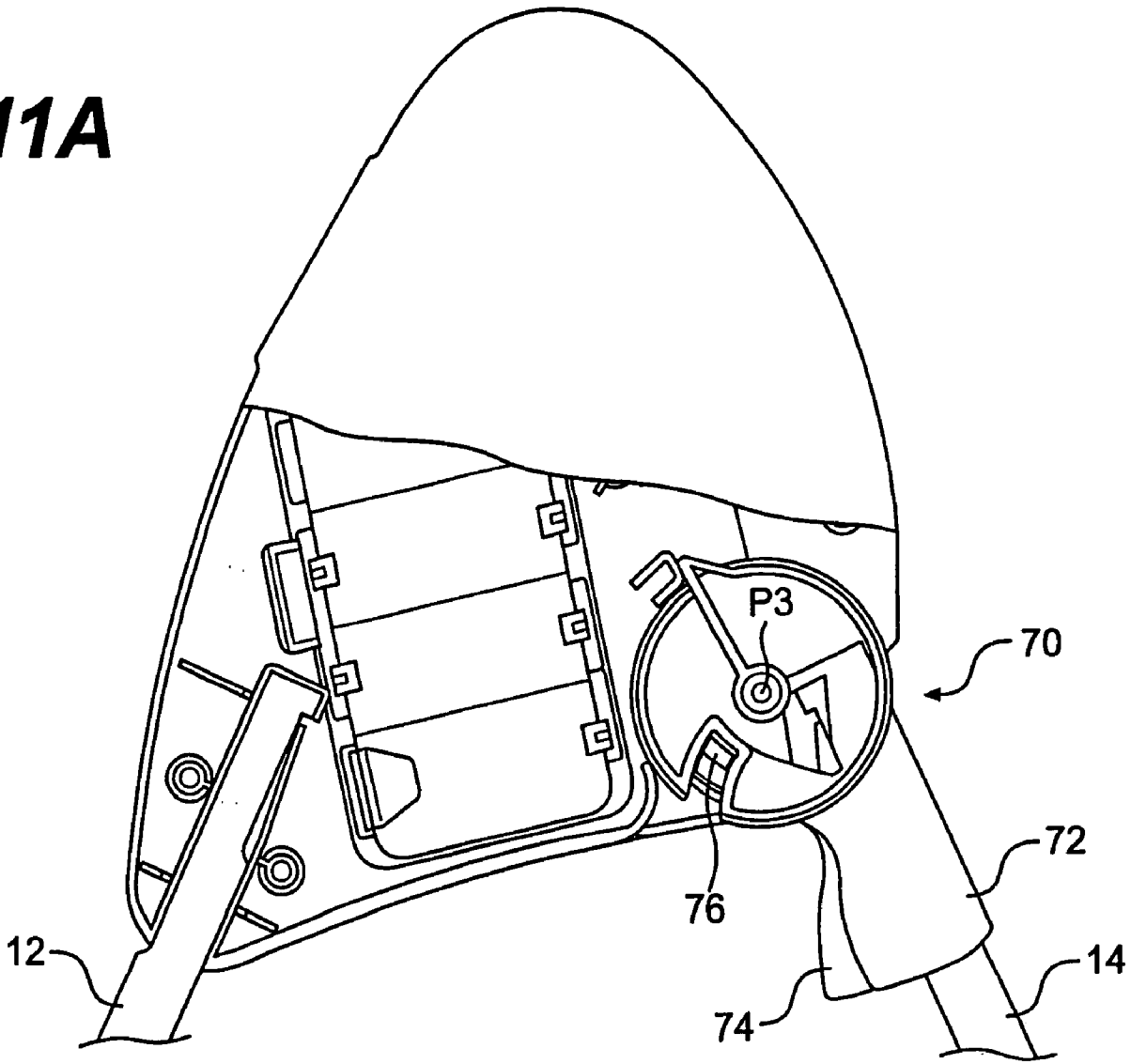
FIG. 11A is a detail view of the rear leg fold mechanism in a locked, in-use position.
Figure 11B:
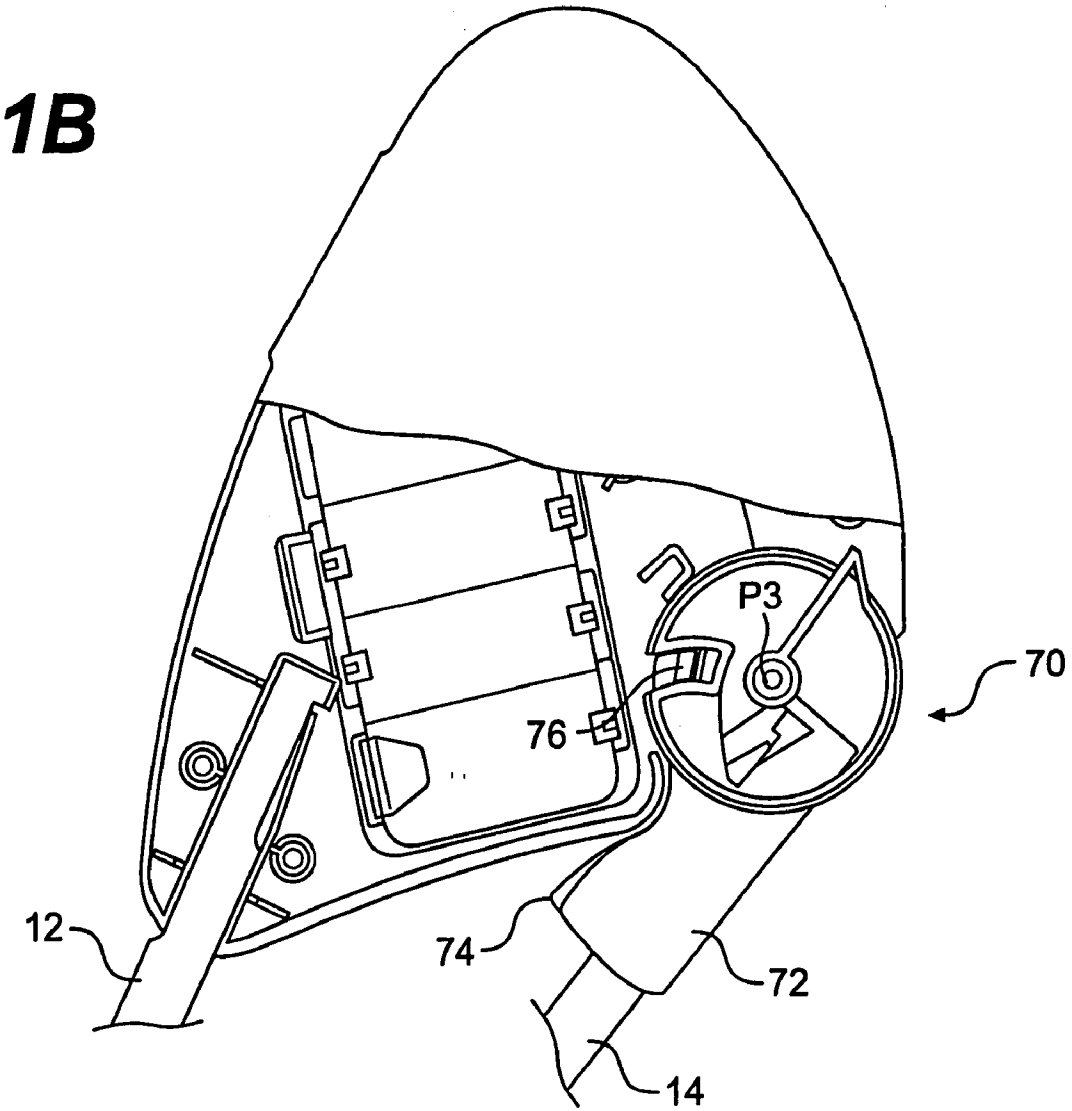
FIG. 11B is a detail view of the rear leg fold mechanism in a fold position.

FIGS. 10, 10A, 11A, and 11B illustrate the rear leg fold mechanism in more detail. The rear leg fold mechanism generally includes a leg socket member 72 to which the rear leg is mounted, a release lever 74, and a locking pin 76 connected to the release lever 74. As shown in FIG. 10A, the locking pin 76 of the illustrated embodiment is formed as part of the release lever 74; however, it will be understood that the locking pin 76 can be molded separately from, and then connected by a suitable fastener to, the release lever 74. The socket member 72 is rotationally mounted to the respective housing 50 about pivot P3 and rotates with the rear leg 14 between the in-use position and the fold position. The locking pin 76 of the release lever 74 is configured to be captured in slots 78, 80 in the socket member 72 and the housing 50, respectively. The slot 78 in the socket member 72 has a slight arc to allow the pin 76 to move radially outward (when the lever 74 is squeezed) and radially inward (when the lever 74 is released). The slot 78 in the housing 50 is generally C-shaped to include a lock area 82, a folded detent area 84, and a travel area 86 between the two. When the lever 74 is released, as shown in FIG. 11A, the pin 74 can remain located in the lower, lock area 82 and the leg 14 cannot rotate. When the lever 74 is squeezed, the pin 76 rotates into the travel area 86 in the housing slot 80, and the pin 76 rides along this track-like area as the rear leg 14 is pivoted to the fold position. FIG. 8 shows the rear legs 14 in a partially pivoted position. In this position, the locking pin 76 is located in travel area 86. When the rear leg 14 is completely folded, as shown in FIG. 11B, the pin 76 is free to move to the folded detent area 84 to lock the leg 14 in place. This area 84 has a lead out angled surface 88 that creates a detent or soft lock. Because there is no positive lock in this area 84, the legs 14 can be moved to the in-use position without squeezing the lever 74. The degree of the angled surface 88 will determine the amount of force needed to move the legs 14 to the in-use position. Although the figures show fold mechanisms associated with the rear legs, it is envisioned that, in an alternative swing arrangement, the fold mechanisms could be associated with the front legs.

In addition to the pivoting of the rear legs 14, the swing handle 60 is pivoted during the fold operation. The swing handle 60 is pivoted from an in-use position (one of the open access position, the lift and lock position, and the entertain position) to the storage position, in the direction of arrow B in FIG. 8. The swing handle 60 can be moved to the storage position either before or after folding of the rear legs 14.

Once the swing handle 60 is in the storage position, the seat back 22 and the seat bottom 24 are pivoted to their fold positions. That is, the seat back 22 and the seat bottom 24 are pivoted toward each other until the back and bottom 22, 24 frictionally engage the detents of the respective ribs 304, 306 on the inner surface of the hanger arms 30. The swing handle 60 nests between the seat back 22 and bottom 24 when all three structures are folded. FIG. 9 illustrates the swing 1 in its fully folded position.

If the user wants to carry the folded swing 1, the user can maintain the swing handle 60 in the lift and lock position shown in FIG. 7 and fold the remaining swing structures, including the rear legs 14, the seat back 22, and the seat bottom 24. In this regard, the swing handle assembly operates independently of the remaining fold structures.

Figure 12:
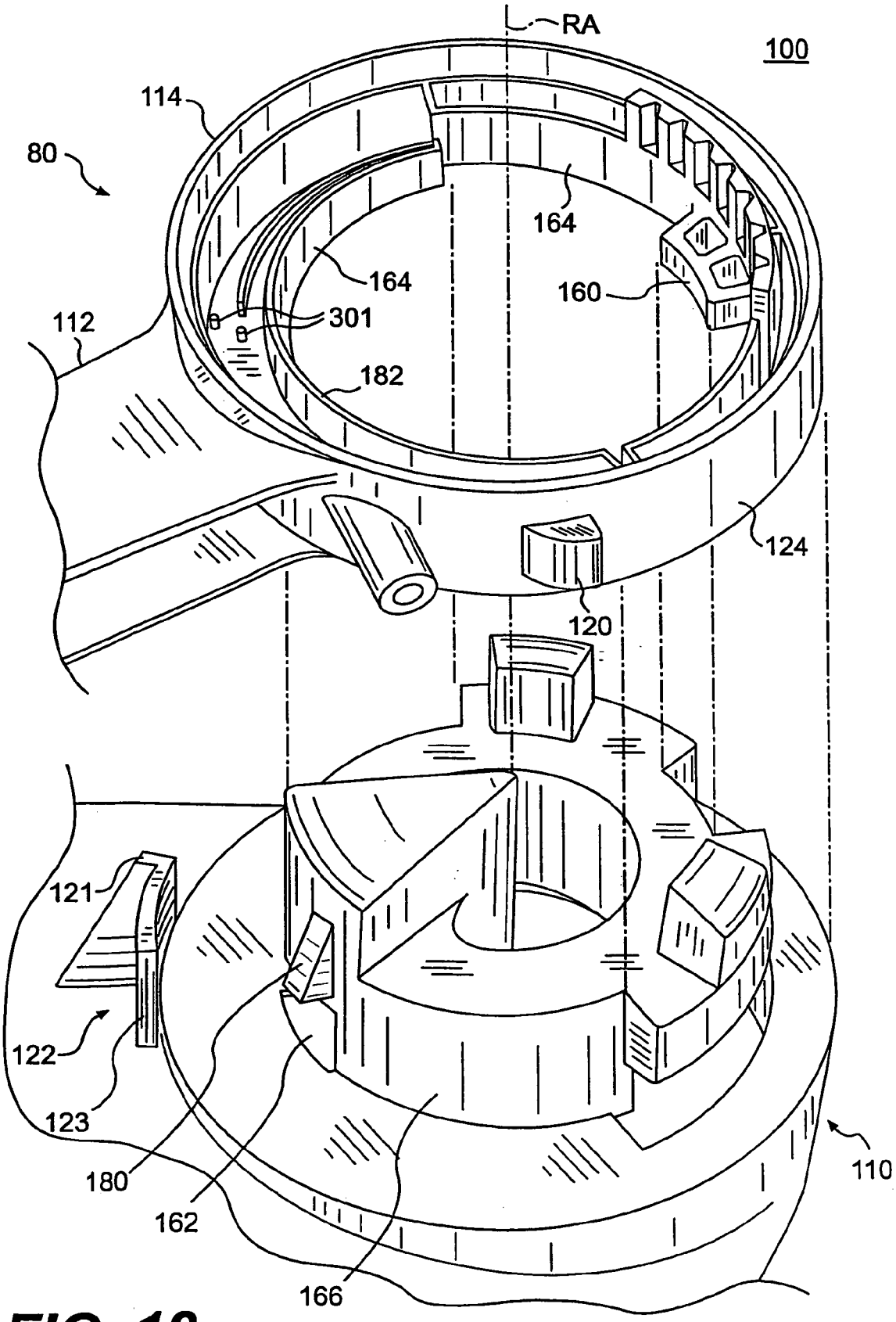
FIG. 12 is an exploded, detail view of a swing handle assembly.

FIG. 12 illustrates a swing handle assembly 100. Such a swing handle assembly 100 is present at each end of the swing handle 60 to mount the swing handle 60 to the frame 10 (shown in FIG. 1). The swing handle assembly 100 includes an end of the swing handle 60 and a handle support structure 110. The handle support structure 110 is positioned within a respective housing 50 (shown in FIG. 1), and it may be integrally molded with the housing 50 or may be attachable to the housing 50. The swing handle 60 is rotationally coupled to the handle support structure 110 such that the swing handle 60 may rotate about a handle rotational axis RA between at least two positions. In addition, the swing handle 60 may include a number of electronic devices 162, as shown in FIG. 1.

The swing handle 60 may comprise a handle portion 112 and a support interface portion 114. The support interface portion 114 is the portion of the swing handle 60 that is attached to the handle support structure 110. The support interface portion 114 is positioned within the respective housing 50 (shown in FIG. 1).

Figure 13:
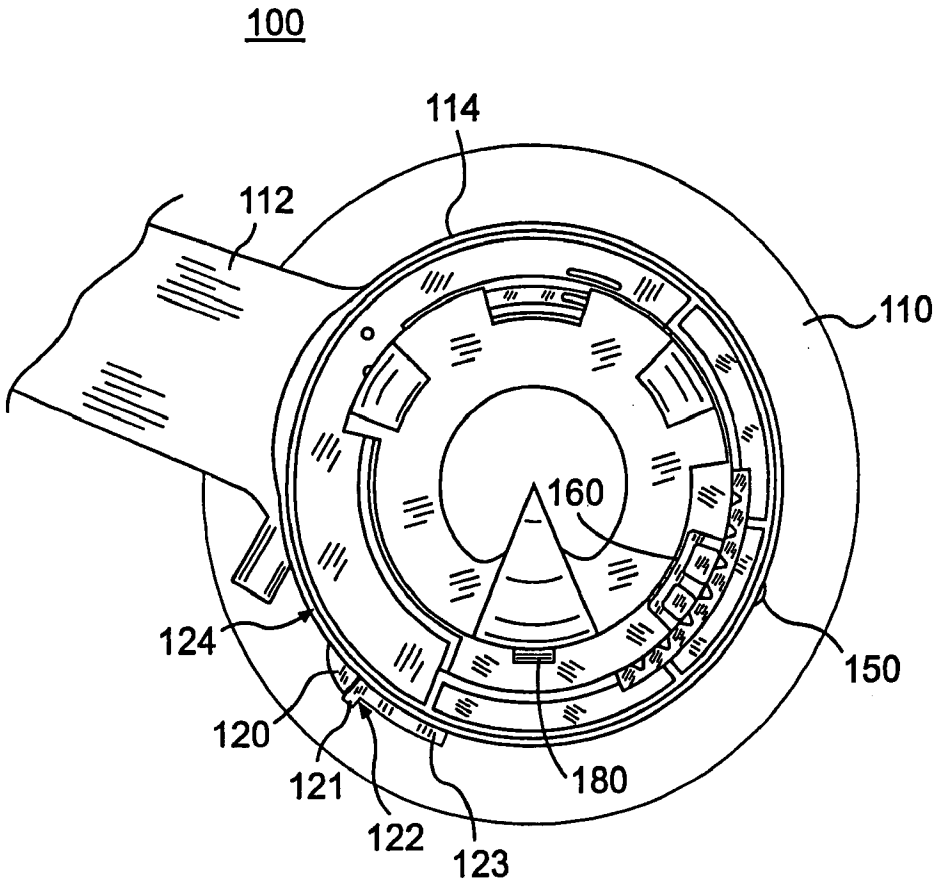
FIG. 13 is a detail view of the right-side, swing handle assembly, where the swing handle is rotated to an open access position.

FIG. 13 illustrates the swing handle 60 rotated relative to the handle support structure 110 so that the swing handle 60 is in an open access position. In this position, a central portion of the swing handle 60, which includes the central portion of the handle portion 112, is arranged rearward of the rotational axis of the handle 60. In this application forward of the rotational axis is toward a front of the swing 1 and rearward of the rotational axis is toward the rear of the swing 1.

Figure 14:
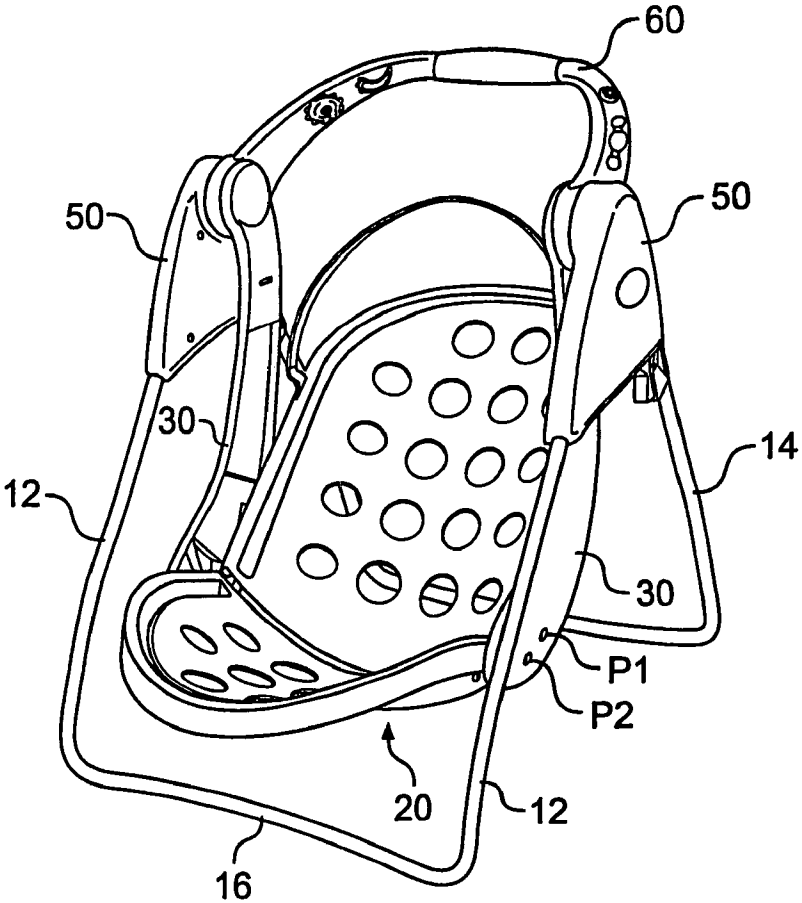
FIG. 14 is a front perspective view of the swing, where the swing handle is in the open access position.

In this open access position, access to the seat 20 is easily facilitated because the swing handle 60 is out of the way relative to the seat 20, as illustrated in FIG. 14. A child may be easily placed in the seat 20 while the swing handle 60 is rotated rearward. In this open access position, the swing handle 60 is stopped from any further rearward rotation relative to the handle support structure 110 and the frame 10. The swing handle 60 is stopped relative to the support structure 110 when a handle stop 120 on the handle 60 meets a support stop 122 on the handle support structure 110.

Referring to FIG. 13, the handle stop 120 is located on an outer peripheral wall 124 of the support interface portion 114. The handle stop 120 may be shaped, for example, as a protrusion with a flat edge facing the support stop 122 when in contact with the support stop 122. The support stop 122 may be shaped, for example, as a protrusion with a flat edge facing the handle stop 120 when in contact with the handle stop 120. In particular, the support stop 122 may be generally L-shaped with a radial rib 121 of the L facing the handle stop 120. The radial rib 120 extends radially from the axis of rotation. The radial rib 121 contacts the handle stop 120 when the handle stop 120 meets the support stop 122. The support stop 122 may also include a circumferential rib 123 extending in a circumferential direction relative to the axis of rotation. In this respect, the support stop 122 has a dual function: to facilitate positioning of the swing handle 60 in the open access position, as explained above, and to facilitate positioning of the swing handle 60 in the entertain position, as will be explained below.

Figure 15:
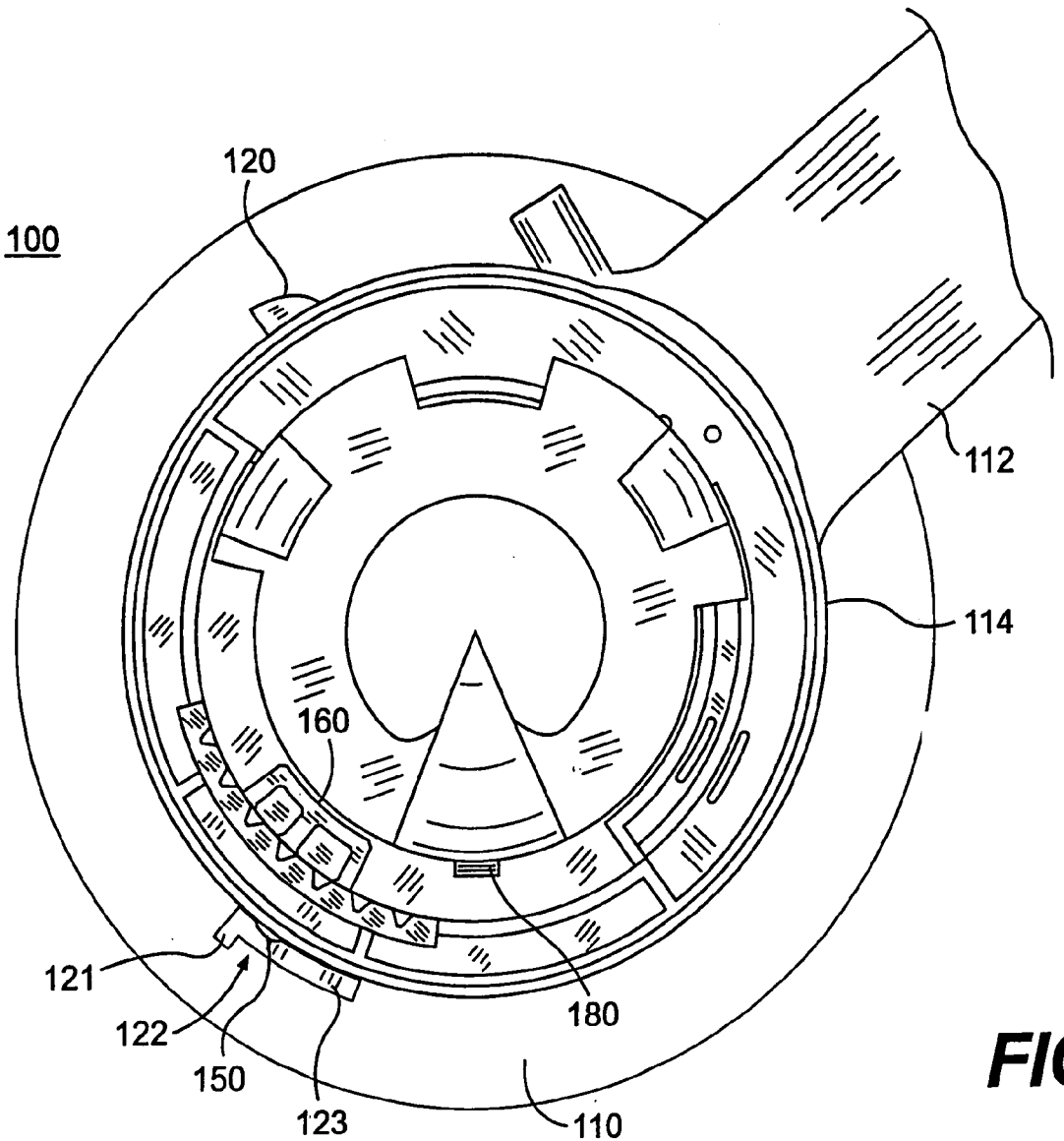
FIG. 15 is a detail view of the right-side, swing handle assembly, where the swing handle is rotated to an entertain position.

Rotation of the swing handle 60 relative to the handle support structure 110 to the entertain position is now described with reference to FIGS. 1, 12, and 15. FIG. 15 illustrates the swing handle 60 rotated relative to the handle support structure 110 so that the swing handle 60 is in an entertain position. In this position, a central portion of the swing handle 60 is arranged forward of the rotational axis of the swing handle 60, when the swing handle 60 is arranged as part of the swing. The swing handle 60 and handle support structure 110 are configured so that, when the swing handle 60 is in this entertain position, the central portion of the swing handle 60 is positioned above and/or in front of a child seated in the swing. Thus, the child would be able to easily view the swing handle 60 and any toys and/or electronic stimuli associated with the handle 60. In this regard, the swing handle 60 may include features to entertain the child. As described further below, the swing handle may include electronic devices 162 (shown in FIG. 1) to provide lights and/or sounds for entertainment.

To maintain the swing handle 60 in the entertain position, the support interface portion 114 includes a detent mechanism that frictionally resists rotational motion by the swing handle 60 in a forward or rearward direction relative to the handle support structure 110 and the swing frame 10. The detent mechanism may comprise, for example, one or more detents on one of the support interface portion 114 of the swing handle 60 and the handle support structure 110. The other of the support interface portion 114 and the handle support structure 110 includes a protrusion, as part of the detent mechanism, arranged such that when the swing handle 60 is rotated in a first direction relative to the handle support structure 110 and the detent and the protrusion meet, the detent frictionally resists rotational motion by the swing handle 60 in the first direction or in a direction opposite to the first direction.

FIG. 15 illustrates an example where the detent 150 is on the support interface portion 114 of the swing handle 60. In this case, the support stop 122 may serve as the protrusion that frictionally resists the detent 150 when the detent 150 and the support stop 122 meet. Alternatively, the protrusion may be other than the support stop 122.

The support stop 122 may be generally L-shaped, as described above with respect to FIGS. 12 and 13. The radial rib 121 of the L extends radially from the center of rotation and acts to stop the handle stop 124, as explained with respect to the open access position of FIG. 13. The radial rib 121 may be angled such that its radially distance from the rotation axis increases along the rotation axis. The circumferential rib 123 of the L extends circumferentially and engages the detent 150 to provide frictional engagement between the support stop 122 and the detent 150 as the detent 150 moves along the support stop 122. The circumferential rib 123 and the height of the detent 150 are set to provide sufficient resistance to rotation to hold the swing handle 60 in the entertain position, but not so much resistance as to make it difficult to rotate the handle out of the entertain position. FIG. 1 illustrates the swing with the handle 60 in the entertain position.

Figure 17:
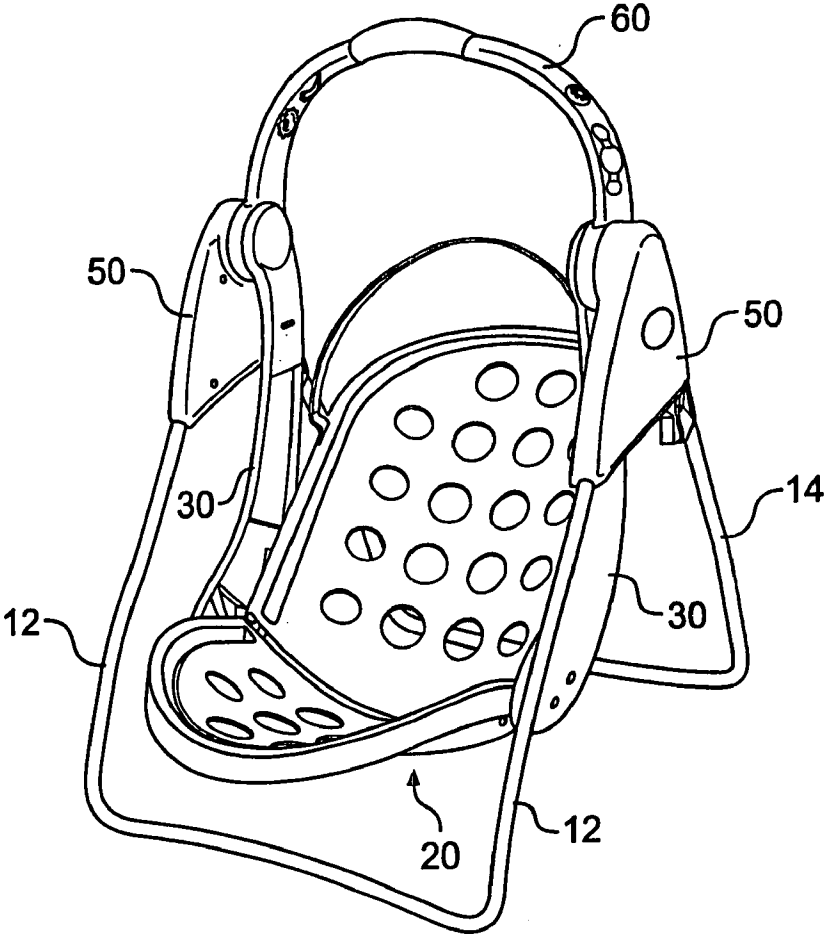
FIG. 17 is a front perspective view of the swing, where the swing handle is in the lift position.
Figure 16:
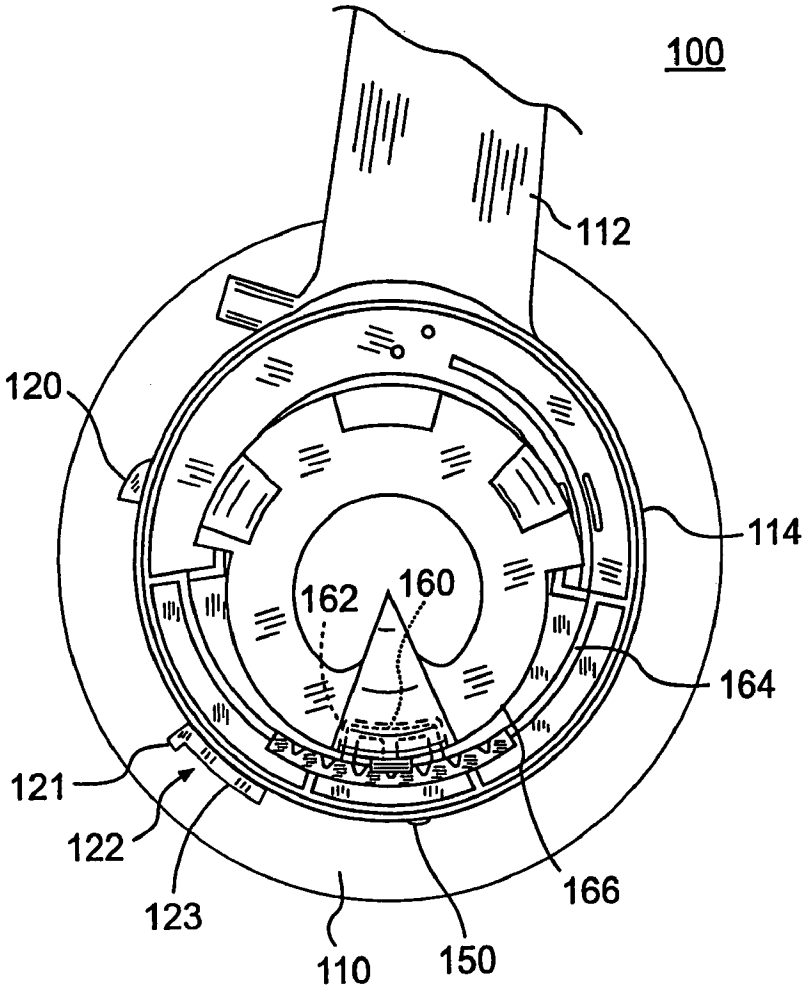
FIG. 16 is a detail view of the right-side, swing handle assembly, where the swing handle is rotated to a lift position.

Rotation of the swing handle 60 relative to the handle support structure 110 to the lift position is now described with respect to FIGS. 12, 16, and 17. FIG. 17 illustrates the swing handle 60 rotated relative to the handle support structure 110 so that the swing handle 60 is in the lift position. In this position, a central portion of the swing handle 60 is arranged generally above the rotational axis of the swing handle 60, when the swing handle is arranged as part of the swing. In this lift position, the swing handle 60 is locked relative to the handle support structure 110 and frame 10. The swing 1 may be lifted by grasping the swing handle 60 and lifting. Because the rotational motion of the swing handle 60 is locked relative to the swing frame 10, the swing 1 may be more easily carried without awkwardness otherwise caused by freely swinging motion of the swing frame 10 relative to the swing handle 60.

The swing handle may be locked relative to the swing frame 10 and handle support structure 110 by means of a protrusion and matching recess. For example, one of the support interface portion 114 of the swing handle 60 and the handle support structure 110 may include a protrusion, and the other of the support interface portion 114 and the handle support structure 110 may include a recess matched to the protrusion such that, when the protrusion is within the recess, the swing handle 60 is locked relative to the handle support structure 110. The locking mechanism of the protrusion and recess may also incorporate a user-activated lock.

FIGS. 12 and 16 illustrate an example where the protrusion 160 is on an inner peripheral wall 164 of the support interface portion 114 of the swing handle 60, and the recess 162 is on an outer peripheral wall 166 of the handle support structure 110. When the swing handle 60 is rotated such that the protrusion 160 lines up with recess 162, the handle 60 may be grasped and lifted so that the protrusion 160 enters the recess 162, and further rotational motion of the swing handle 60 relative to the handle support structure 110, in either rotational direction, is prevented. The locking of the handle 60 relative to the handle support structure 110 may be released by lowering the handle 60 (such as by pushing on the handle 60) relative to the handle support structure 110 to disengage the protrusion 160 from the recess 162. FIG. 17 illustrates the swing with the handle 60 in the lift position.

The lift and lock mechanism described above with the matching protrusion and recess provides a number of advantages. Locking action is transparent to the user with no secondary action required. Moreover, the design uses few moving parts and is easy to assemble. Further, cost effective materials can be used to achieve the desired function.

Figure 21:
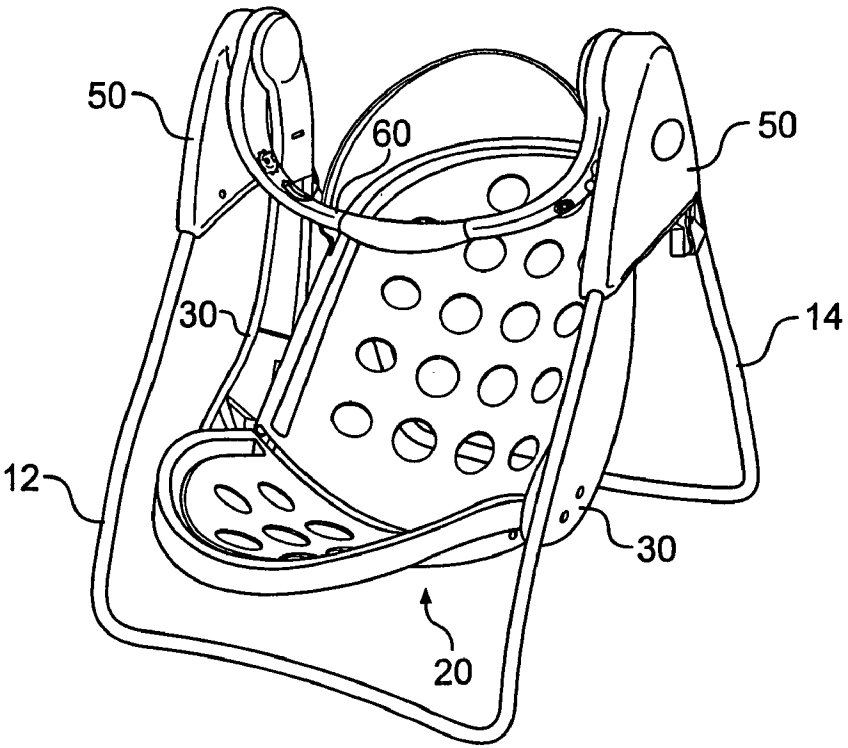
FIG. 21 is a front perspective view of the swing, where the swing handle is rotated to the storage position.
Figure 20:
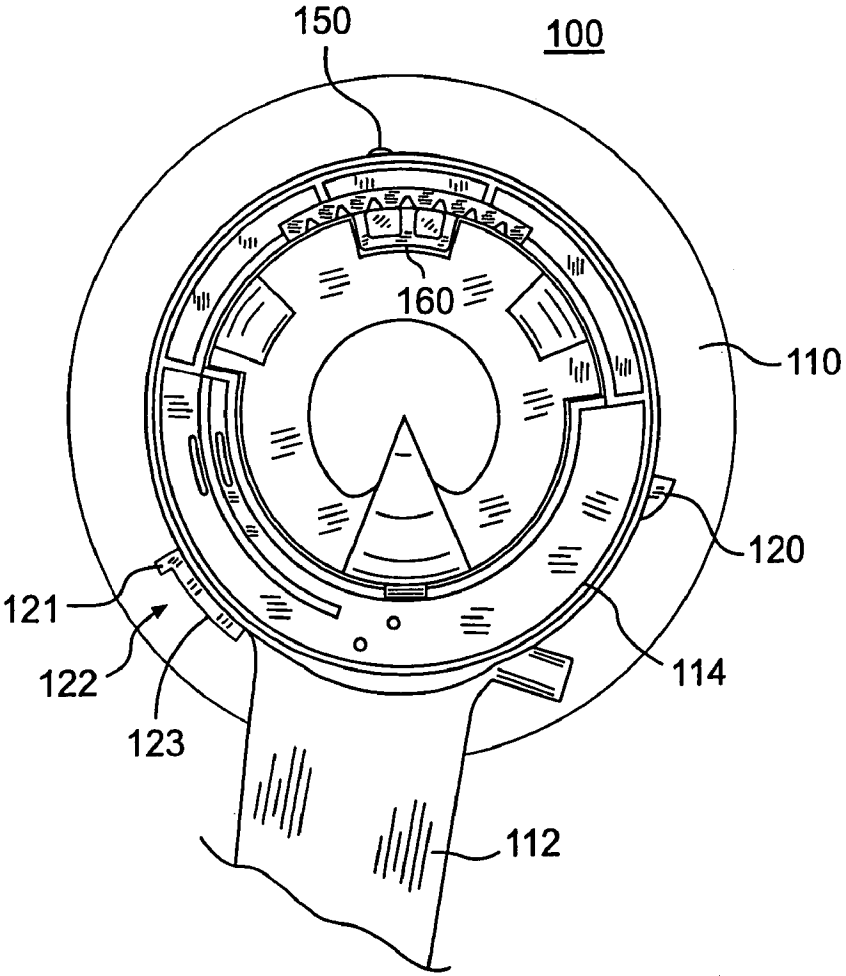
FIG. 20 is a detail view of the right-side, swing handle assembly, where the swing handle is rotated to a storage position.

Rotation of the swing handle 60 relative to the handle support structure 110 to the storage position is now described with respect to FIGS. 12, 20, and 21. FIG. 21 illustrates the swing handle 60 rotated relative to the handle support structure 110 so that the swing handle 60 is in a storage position. In the storage position, the rotational motion of the swing handle 60 relative to the handle support structure 110 need not be stopped, locked, or frictionally resisted by structures on the swing handle 60 and/or handle support structure 110, because the relative rotation is prevented by nesting of the swing handle 60 between the seat back 22 and the seat bottom 24 of the seat 20. The swing handle 60 may be nested between the seat back 22 and the seat bottom 24 of the seat 20, when the swing is in a folded position.

As seen in FIG. 12, the handle 60 and handle support structure 110 include structure to allow the handle 60 to be snapped onto the handle support structure 110, and thereafter the handle 60 is rotationally fixed to the handle support structure 110. In this regard, the outer peripheral wall 166 of the handle support structure 110 includes a snap finger 180. When the handle 60 is assembled to the handle support structure 110 such that the inner peripheral wall 164 of the support interface section 114 passes over and past the snap finger 180, the snap finger 180 extends radially outward and beyond a lip 182 of the inner peripheral wall 164. This extension of the snap finger 180 beyond the lip 182 prevents the handle 60 from being slid off of the handle support structure 110.

Figure 18:
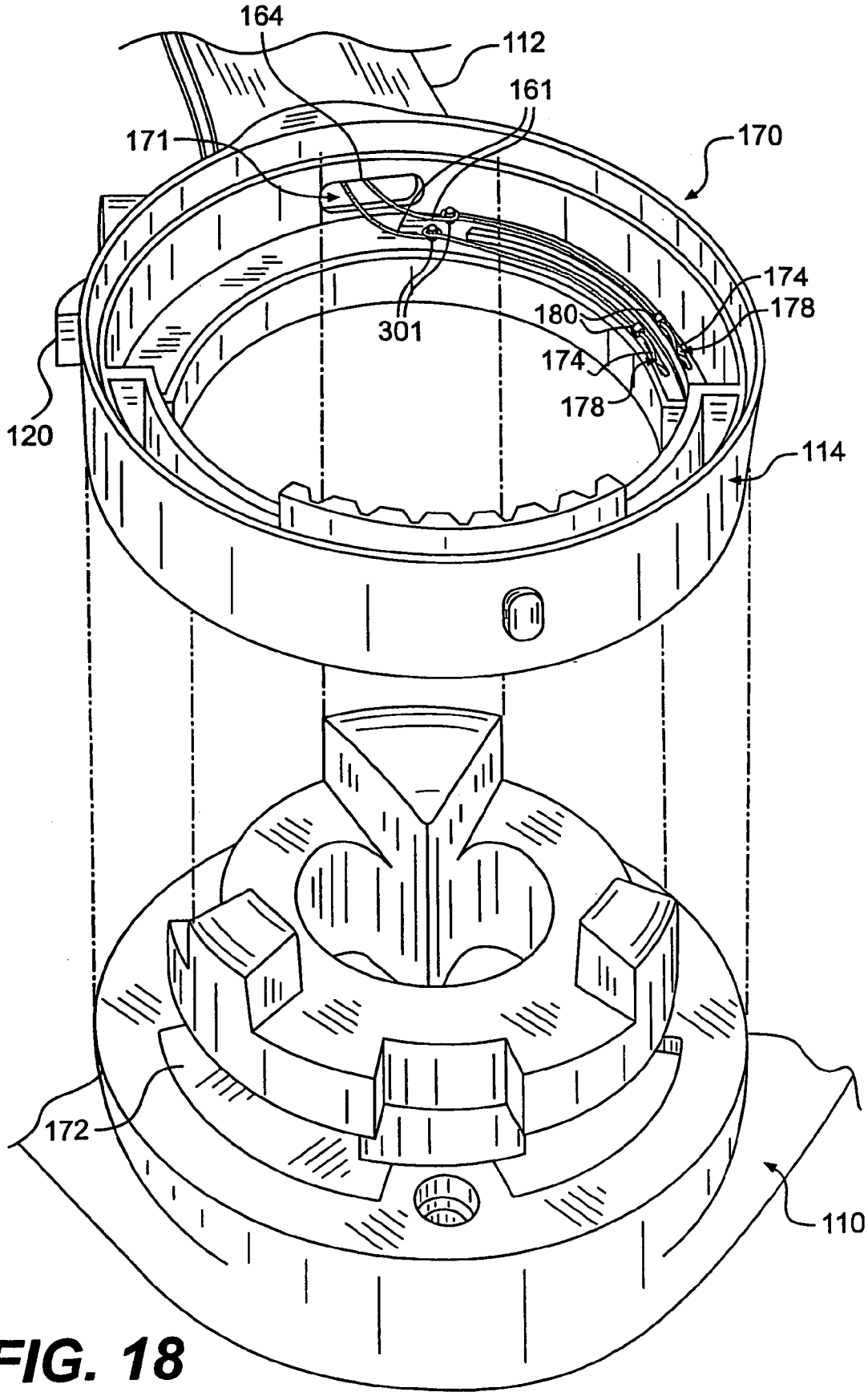
FIG. 18 is an exploded, detail view of a swing handle assembly including a moving contact assembly.
Figure 19:
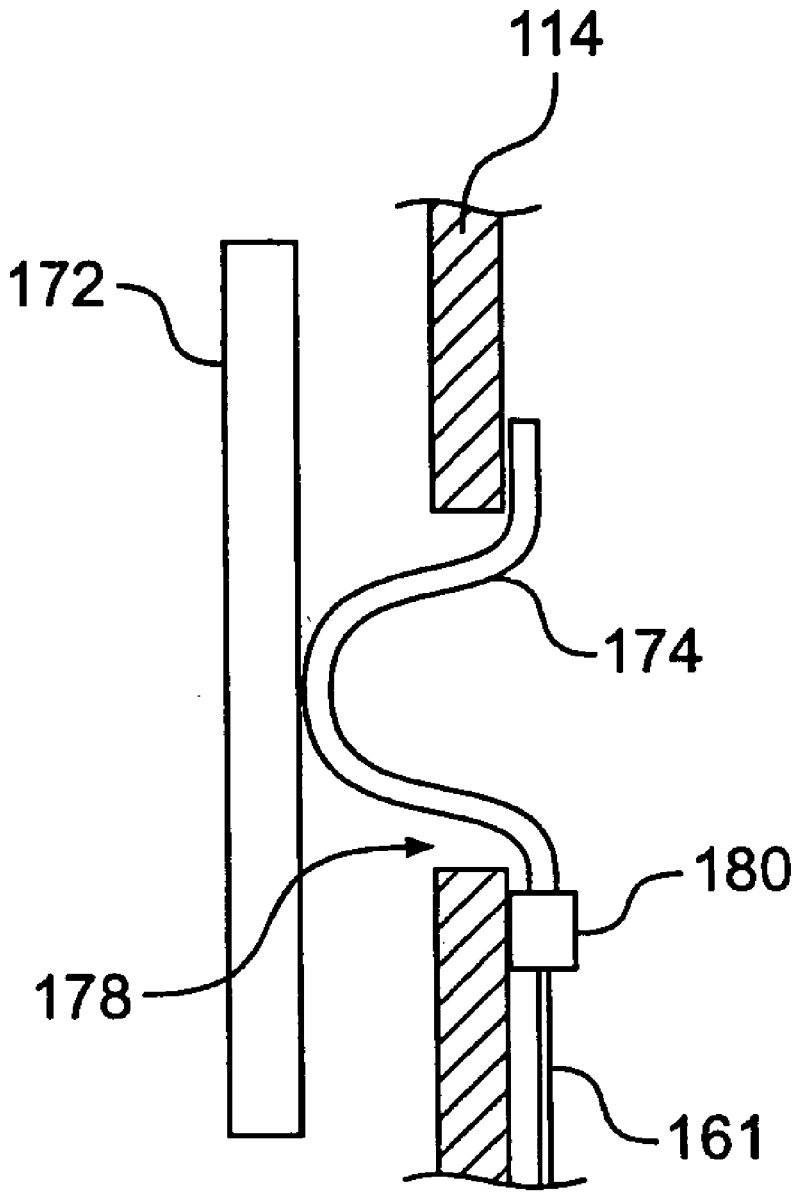
FIG. 19 is a side view of a spring contact and an arc shaped contact.

FIGS. 18 and 19 illustrate electrical wiring 161 that extends from the handle portion 112 of the swing handle 60 into and through the support structure 110 so that electronic devices 162 (see FIG. 1) on the handle portion 112 may be powered by a power supply not in the handle portion 112, but in one of the housings 50.

The wiring 161 extends into a cavity 164 within the handle portion 112 to the electronic devices 162 on the handle portion 112. The electronic devices may be, for example, light producing electronic devices and/or sound producing electronic devices. For example, if the electronic devices 162 are for the entertainment of a child in the swing, one or more of the electronic devices 162 may be a colored light shaped as a pleasing design for a child, such as a star or a cat. The electronic devices 162 may also produce sounds instead of, or in addition to, light. For example, if the electronic device is a colored light shaped as a cat, the device may also produce a "meow" sound. One or more of the electronic devices 162 may also produce sounds such as music, for example.

The support interface portion 114 may include an outer peripheral wall 170 adjacent the handle portion 112. In order to pass the wiring 161 from the cavity 164 of the handle portion 112 to the support interface portion 114 of the handle 60, the outer peripheral wall 170 may include a slot 171. The slot 171 allows for an electrical connection between the handle portion 112 and the interface portion 114. An electrical connection or contact between the support interface portion 114 and the handle support structure 110 may be implemented by means of at least one moving contact assembly.

Beneficially the moving contact assembly allows electronics to be powered in a movable handle, i.e., the handle 60, through wiring passing through a rotating joint, i.e., the joint of the support interface portion 114 and the handle support structure 110.

The moving contact assembly may comprise a generally arc shaped contact 172 on the handle support structure 110 and at least one spring contact 174 on the support interface portion 114. The spring contacts 174 are adapted to electrically contact the generally arc shaped contact 172 as the swing handle 60 rotates relative to the handle support structure 110.

The generally arc shaped contact 172 may comprise a printed circuit board or conductive ink formed on a surface of the handle support structure 110, for example. If the generally arc shaped contact 172 comprises a printed circuit board, the handle support structure 110 may comprise a board mounting slot, so that the printed circuit board may be fixedly attached to the handle support structure 110 via the board mounting slot by snapping into the slot. Alternately the printed circuit board may be fixedly attached to the handle support structure 110 by screws or glue. The wiring 160 electrically contacts the generally arc shaped contact 172 via spring contacts 174.

The spring contacts 174 may be formed of any appropriate material, and may be, for example, formed of a sheet metal stamping, conductive plastic, or graphite, for example.

The spring contacts 174 may pass through respective slots of the at least one slot 178 on the support interface portion 114. The wiring 161 may we attached to the support interface portion 114 by wrapping the wiring 161 around respective support posts 301. The spring contacts 174 may be attached to the wiring 161 using a contact snap 180 attached to the support interface portion 114. Power supply wiring (not shown) may then extend from the generally arc shaped contact 172 to the power supply 52 (shown in FIG. 1).

The moving contact assembly comprising the generally arc shaped contact 172 and the spring contacts 174 provides an electrical contact between the generally arc shaped contact 172 and the spring contacts 174 as the swing handle 60 is rotated relative to the handle support structure 110. The arc length of the generally arc shaped contact 172 determines the rotational range over which electrical contact is maintained between the generally arc shaped contact 172 and the spring contacts 174, and thus the range over which power is supplied to the electronic devices 162. Because the electrical devices 162 may need to operate only over a limited rotational range of the handle 60, limiting the arc length of the generally arc shaped contact 172 is possible, and the limited size of the generally arc shaped contact 172 may beneficially reduce its cost. The electrical devices 162 may need to operate only over a rotational range where the swing handle 60 rotates over a certain angle forward and rearward of the entertain position, for example. In one embodiment, the position and arc length of the generally arc shaped contact 172 is configured so that the electrical devices 162 work at the lift position and at ±60 degrees from the lift position, where +60 degrees includes the entertain position.

As an alternative, the swing handle 60 itself may contain a battery support structure for containing batteries and providing power to the electronic devices 162 on the swing handle 60. In this case, the swing handle 60 need not include wiring to the power supply 52 within the housing 50.

An alternative swing handle or handles will now be described with respect to FIGS. 22–26 in accordance with the invention. In this embodiment, the swing 1 may be an open top swing. As shown in FIG. 23, the area between the uppermost portions of the swing frame is open so that a child can easily be installed in or removed from the swing seat by the user. The swing 1 may include a toy bar (not shown) with one or more decorative objects attached. The swing 1 may have a fold mechanism in a similar fashion to the fold mechanism illustrated with respect to FIGS. 7–11B.

The handle configuration of a two handle swing (see FIG. 22) provides advantages over that of a single handle swing (see FIG. 1). For example, the two swing handles 260 allow for a more compact fold of the swing, since no handle components nest between the seat back 22 and bottom 24, and cost less to manufacture.

Figure 22:
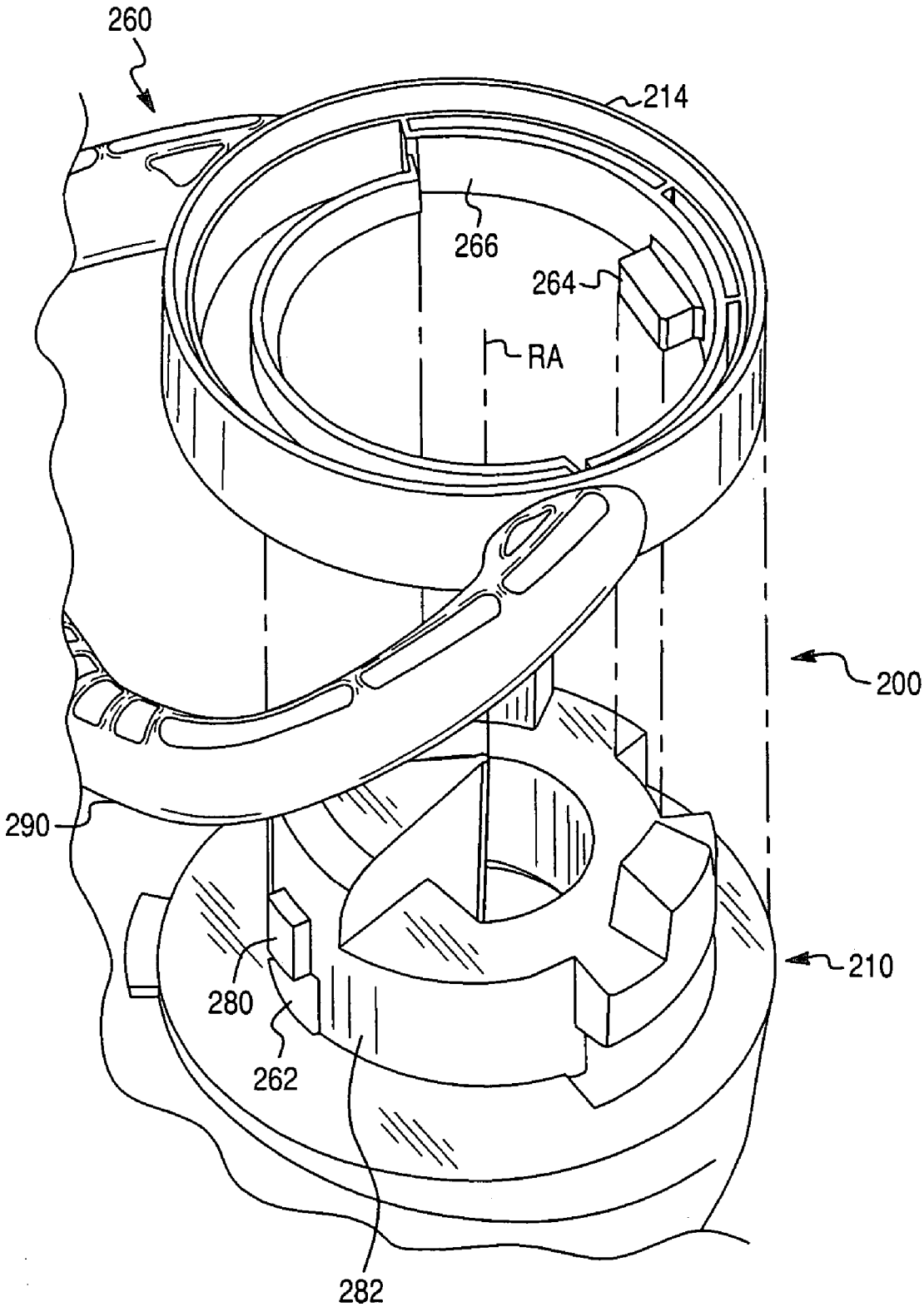
FIG. 22 is an exploded, detail view of a swing handle assembly in accordance with an embodiment of the invention.
Figure 23:
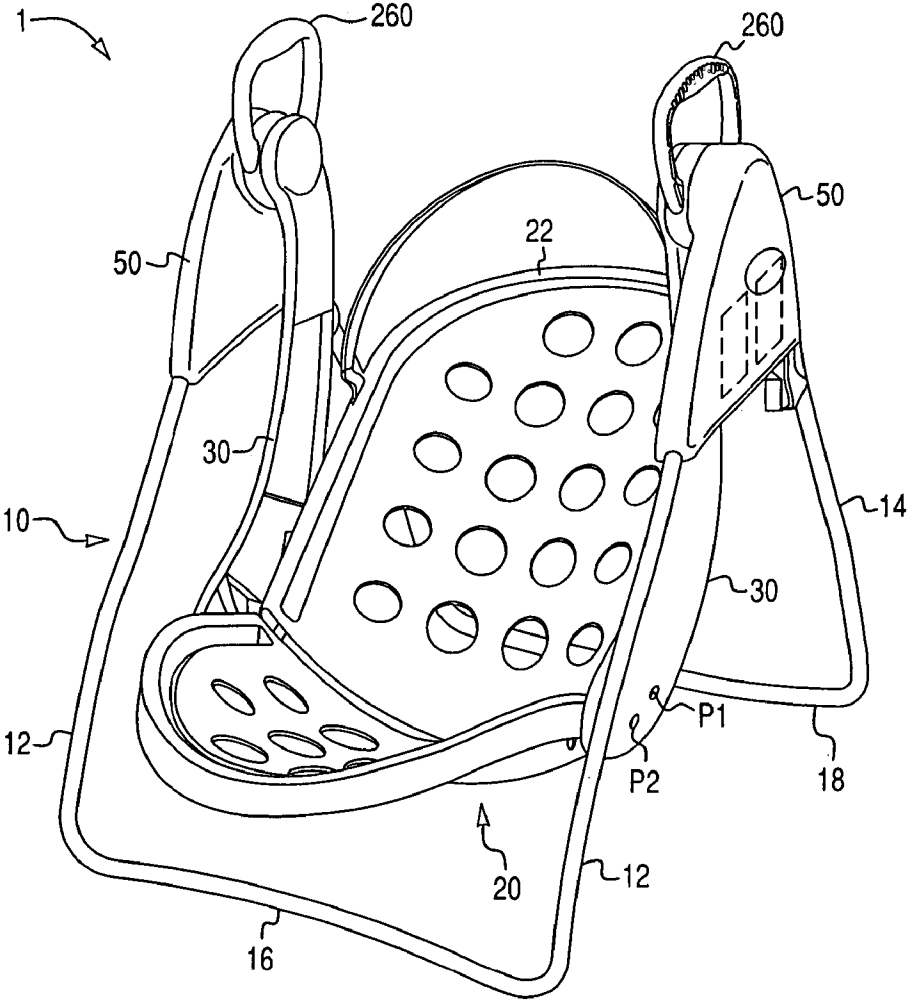
FIG. 23 is a front perspective view of the swing according to the embodiment of FIG. 22, where the swing handle is rotated to a top position.

FIG. 22 illustrates a swing handle assembly 200 according to an embodiment of the invention. In this embodiment, as shown in FIG. 23, the swing 10 may include two swing handle assemblies 200, each swing handle assembly including a respective swing handle 260 coupled to a respective housing 50 of the swing. Each swing handle assembly 200 includes a swing handle 260 and a handle support structure 210. The swing may have two handle support structures 210, wherein each of the swing handles 260 is rotationally coupled to a respective one of opposing handle support structures 210. The handle support structure 210 is positioned within a respective housing 50, and it may be integrally molded with the housing 50 or may be attachable to the housing 50. The swing handle 260 is rotationally coupled to the handle support structure 210 such that the swing handle 260 may rotate about a handle rotational axis RA between at least two positions.

The swing handle 260 may comprise a hand grip portion 290 and a support interface portion 214. The hand grip portion 290 is a portion of the swing handle 260 with a shape that allows for the fingers of a hand to grip the handle 260. The support interface portion 214 is the portion of the swing handle 260 that is attached to the handle support structure 210. The support interface portion 214 is positioned within the respective housing 50 (shown in FIG. 23).

Figure 24:
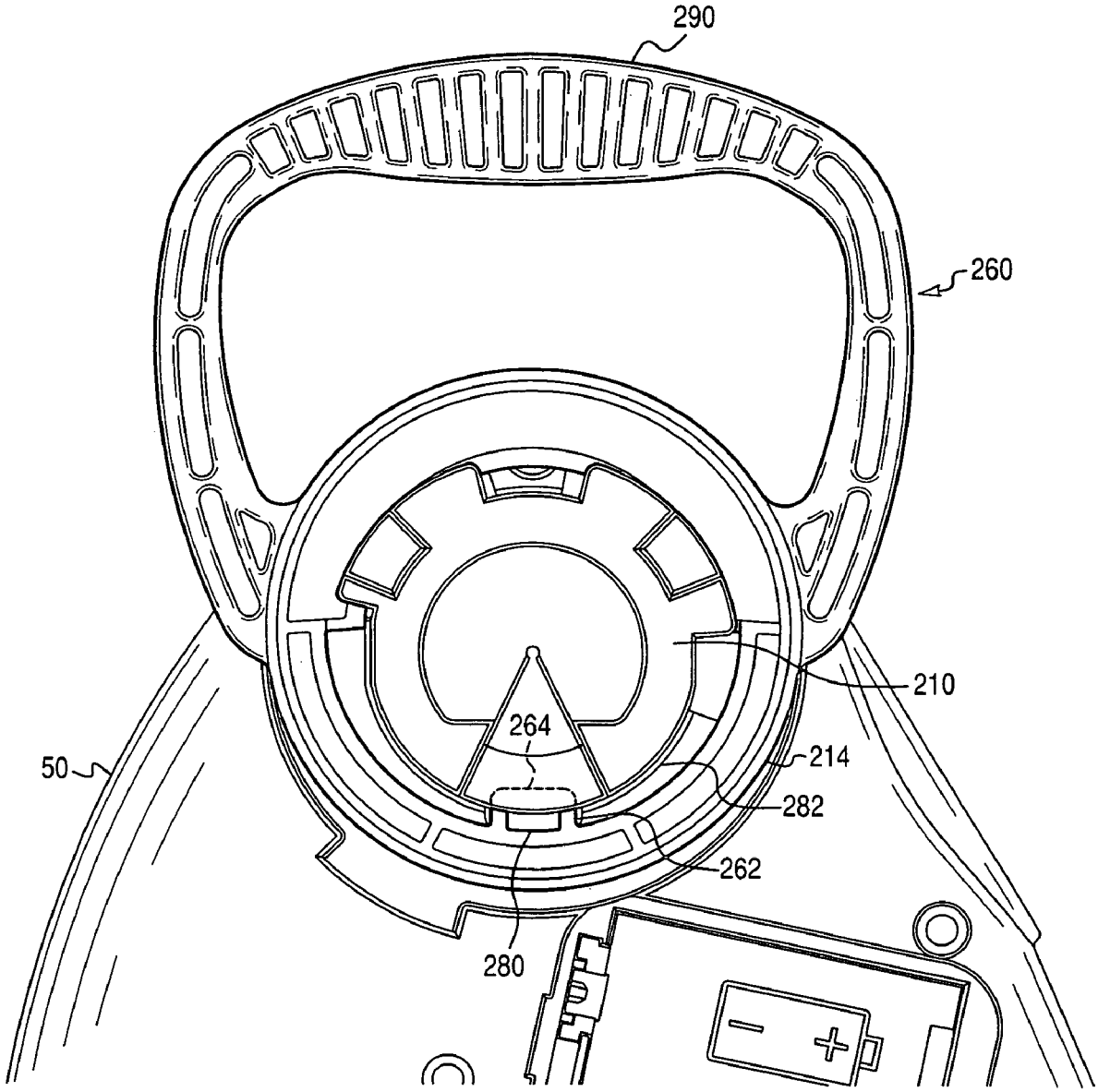
FIG. 24 is a detail view of the right-side, swing handle assembly of the embodiment of FIG. 22, where the swing handle is rotated to an top lift and lock position.
Figure 26:
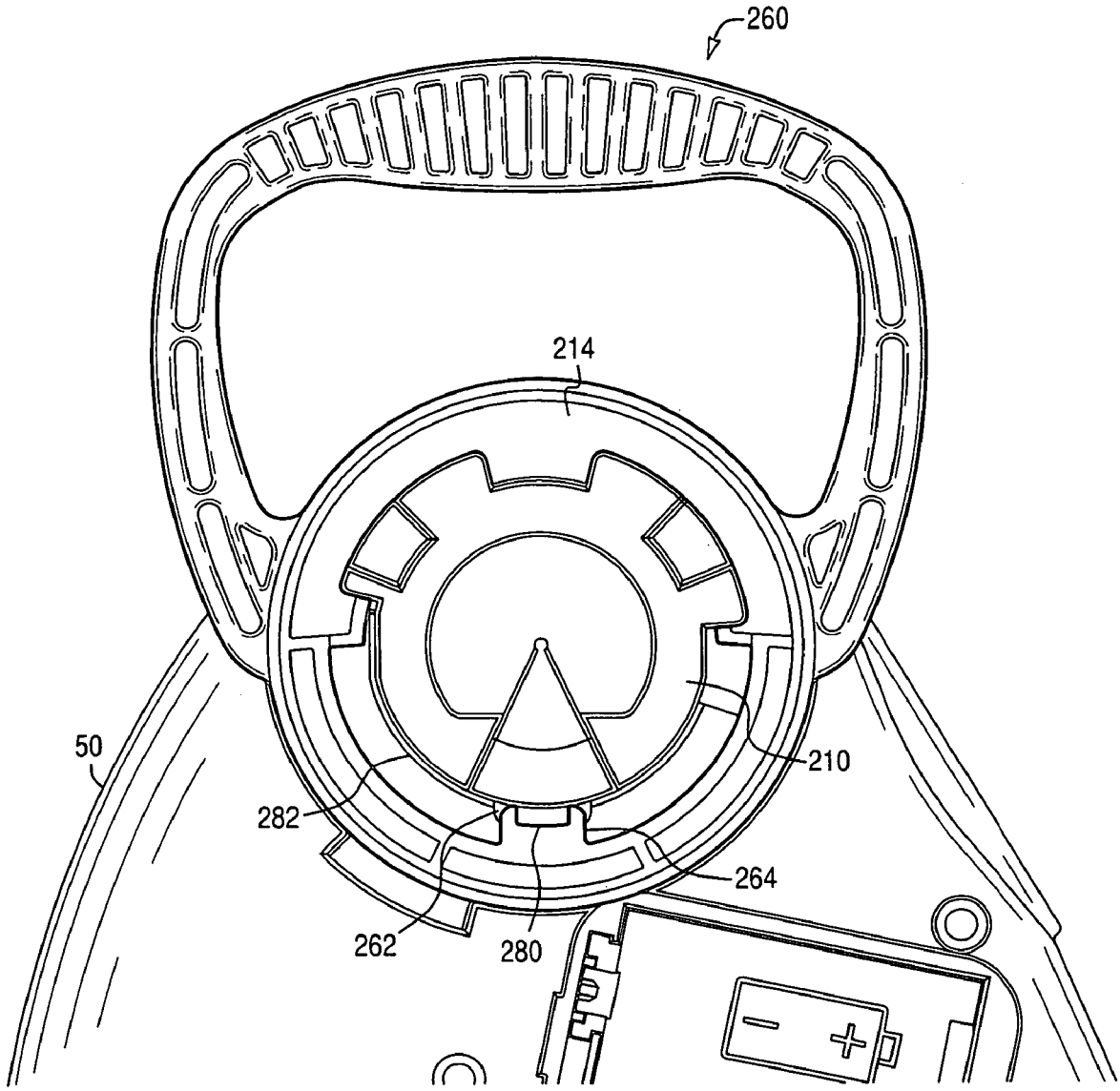
FIG. 26 is a detail view of the right-side, swing handle assembly of the embodiment of FIG. 22, where the swing handle is rotated to a top position and the handle is free to rotate.

FIGS. 24 and 26 illustrate the swing handle 260 rotated relative to the handle support structure 210 so that the swing handle is in a first, top position where the hand grip portion 290 is substantially the top portion of the handle.

Figure 25:
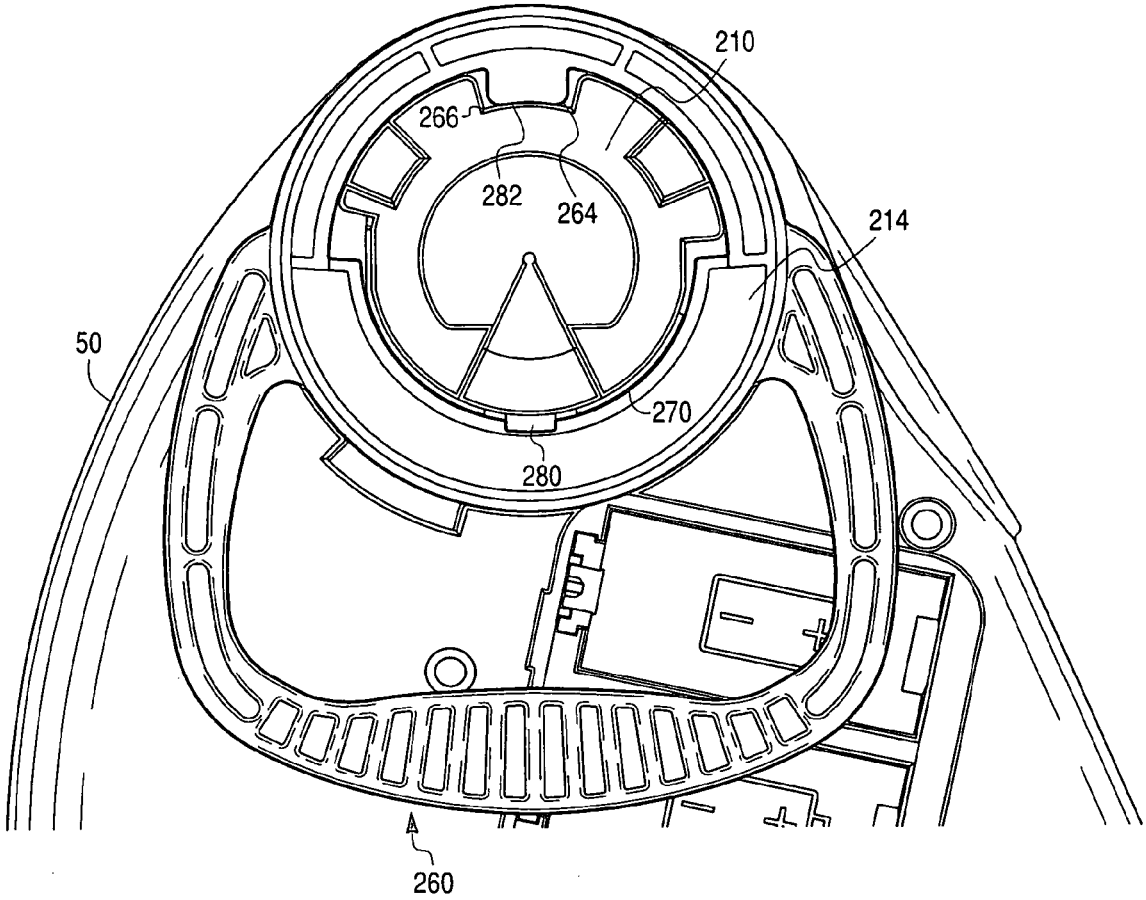
FIG. 25 is a detail view of the right-side, swing handle assembly of the embodiment of FIG. 22, where the swing handle is rotated to a bottom position.

FIG. 25 illustrates the swing handle 260 rotated relative to the handle support structure 210 so that the swing handle 260 is in a second, bottom position. The top position (as shown in FIGS. 24 and 26) is substantially directly above the bottom position (as shown in FIG. 25) and rotated about 180° relative to the bottom position. In this bottom position, the swing handle 260 is rotated to be out of the way relative to the top portion of the swing. In this out of the way position, the appearance of the swing is improved. Further, in this out of the way position, storage of the swing is facilitated in a similar fashion to that described above for the swing handle of FIGS. 12, 20, and 21.

In the bottom position, a protrusion 264 on an inner peripheral wall 266 of the handle support interface 214 rests on an outer peripheral wall 282 of the handle support structure 210. The protrusion 264 extends radially inward from the inner peripheral wall 266. An inner peripheral shoulder 270 of the handle support interface 214 is guided in part by a second protrusion 280 on the bottom of the handle support structure 210. The second protrusion 280 extends radially outward from the handle support structure 210. When the handle 260 is rotated near the bottom position, the handle 260 is guided in this rotation as the inner peripheral shoulder 270 slides past the second protrusion 280.

Rotation of the swing handle 260 relative to the handle support structure 210 to the top position is now described with respect to FIGS. 24 and 26. FIGS. 24 and 26 both shown the swing handle 260 rotated to the top position. FIG. 24 shows the swing handle 260 in the lift and lock position, while in FIG. 26, the handle 260 is in a position where it is free to rotate. In the lift and lock position of FIG. 24, the swing handle 260 is locked relative to the handle support structure 210 and frame 10. The swing 1 (see FIG. 23) may be lifted by grasping the swing handles 260 and lifting. Because the rotational motion of the swing handles 260 is locked relative to the swing frame 10, the swing 1 may be more easily carried without awkwardness otherwise caused by freely swinging motion of the swing frame 10 relative to the swing handles 260.

The swing handle 260 may be locked relative to the swing frame 10 and handle support structure 210 by means of the protrusion 264 and matching recess 262. In FIG. 24, the support interface portion 214 of the swing handle 260 includes the protrusion 264, and the handle support structure 210 includes the recess 262 matched to the protrusion 264 such that, when the protrusion 264 is engaged in the recess 262, the swing handle 260 is locked relative to the handle support structure 210. Alternatively, the support interface portion 214 of the swing handle 260 may include a recess, and the handle support structure 210 may include a protrusion matched to the recess on the support interface portion 214. The locking mechanism of the protrusion and recess may also incorporate a user-activated lock.

FIGS. 24 and 26 illustrate an example where the protrusion 264 is on an inner peripheral wall 266 of the support interface portion 214 of the swing handle 260, and the recess 262 is on an outer peripheral wall 282 of the handle support structure 210. When the swing handle 260 is rotated such that the protrusion 264 lines up with recess 262, the handle 260 may be grasped and lifted so that the protrusion 264 enters the recess 262, and further rotational motion of the swing handle 260 relative to the handle support structure 210, in either rotational direction, is prevented. The locking of the handle 260 relative to the handle support structure 210 may be released by lowering the handle 260 (such as by pushing on the handle 260) relative to the handle support structure 210 to disengage the protrusion 264 from the recess 262. When the handle 260 is released and the protrusion 264 is disengaged from the recess 262, the handle may freely rotate. During rotation, the handle support interface 214 slides relative to the handle support structure 210.

The lift and lock mechanism described above with the matching protrusion and recess provides a number of advantages. Locking action is transparent to the user with no secondary action required. Moreover, the design uses few moving parts and is easy to assemble. Further, cost effective materials can be used to achieve the desired function.

FIGS. 27–30 illustrate another embodiment of the invention where the swing has at least one leg that is adjustable in length. In this embodiment, the swing 1 may be an open top swing in a similar fashion to the swing shown in FIG. 1 or 23, where the same reference numerals refer to the same or like parts. In this embodiment, however, the legs 312 are adjustable in length.

Figure 27:
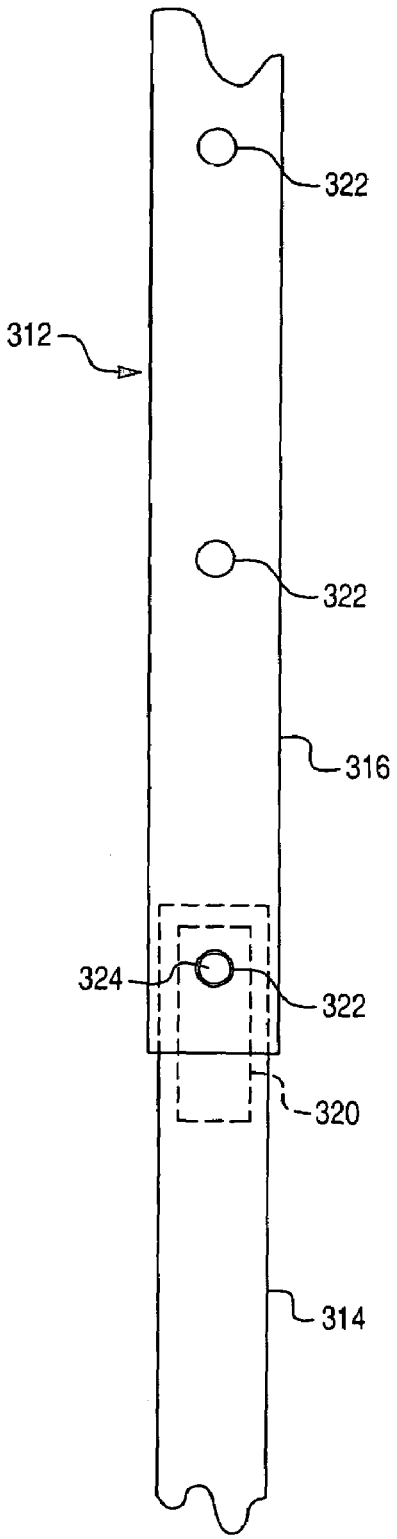
FIG. 27 is a detail view of a portion of an adjustable length leg of a swing.

FIG. 27 illustrates a portion of one of the legs 312 according to one aspect of this embodiment. The leg 312 includes a first portion 314 and second portion 316, where the first portion 314 slides within the second portion 316 to enable adjustment of the length of the leg 312. The first portion 314 and the second portion 316 may comprise tubes, for example.

The leg 312 also includes a length adjustment mechanism that allows the leg to be adjusted and then fixed at a desired length. The length adjustment mechanism may be on the two rear legs of the swing, on the two front legs, or on both the rear legs and front legs, for example.

The length adjustment mechanism may comprise a combination of one or more spring members 320 with protrusions 324 and one or more holes 322. The spring members 320 with holes are disposed on the first portion 314 of the leg and the holes 322 on the second portion 316 of the leg. The holes 322 are sized to receive a protrusion 324, and when a protrusion is engaged in one of the holes 322, the first portion 314 is prevented from sliding relative to the second portion 316.

The spring members 320 may comprise plastic snap or spring buttons, for example. The spring members 320 may configured similarly to metal VALCO snap buttons.

Figure 28:
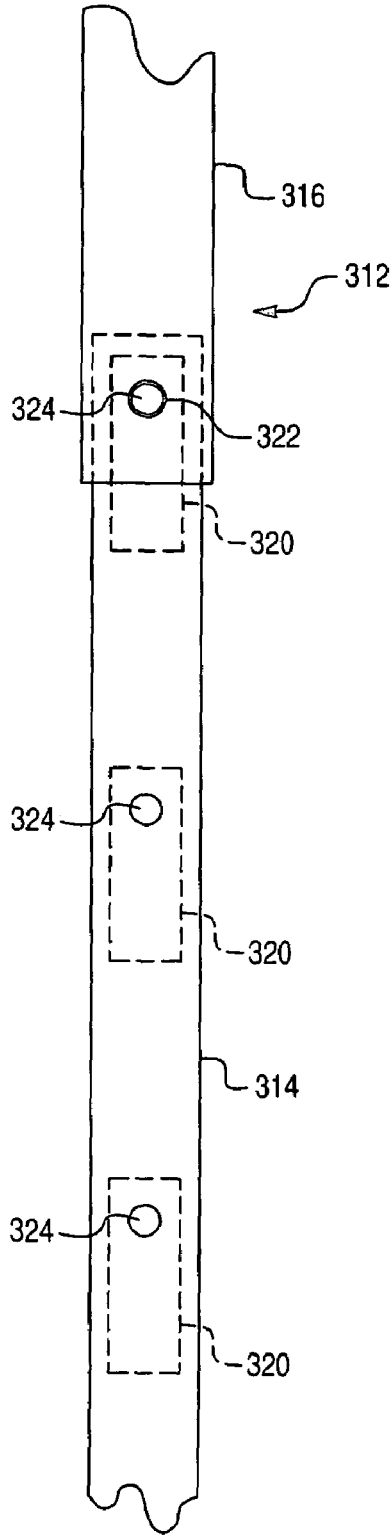
FIG. 28 is a detail view of a portion of an alternative adjustable length leg of a swing.

FIG. 27 illustrates an aspect of this embodiment where the length adjustment mechanism comprises a single spring member 320 with a protrusion 324 on the first portion 314, and multiple holes 322 on the second portion 316. Alternatively, as shown in FIG. 28, the length adjustment mechanism may comprise multiple spring members 320 with respective protrusions 324 on the first portion 314, and a single hole 322 on the second portion 316.

Figure 29:
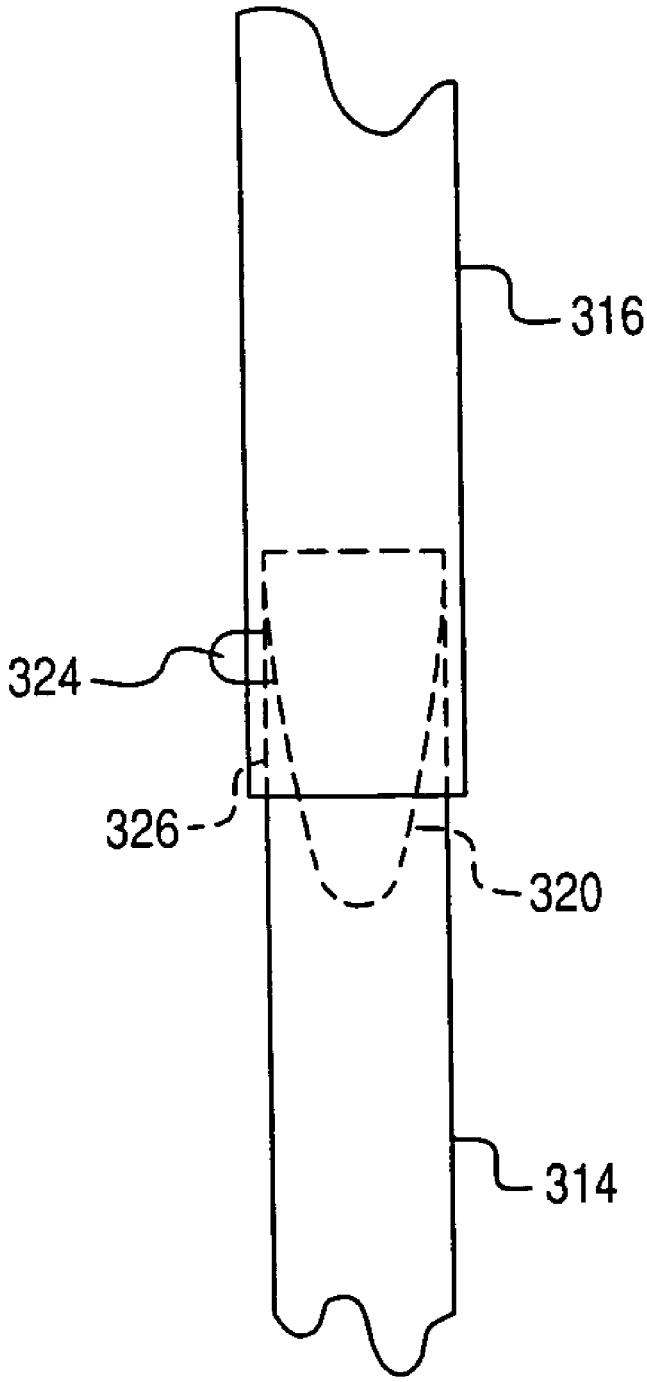
FIG. 29 is a side view of a portion of an adjustable length leg illustrating a length adjustment mechanism according to an embodiment of the invention.
Figure 30:
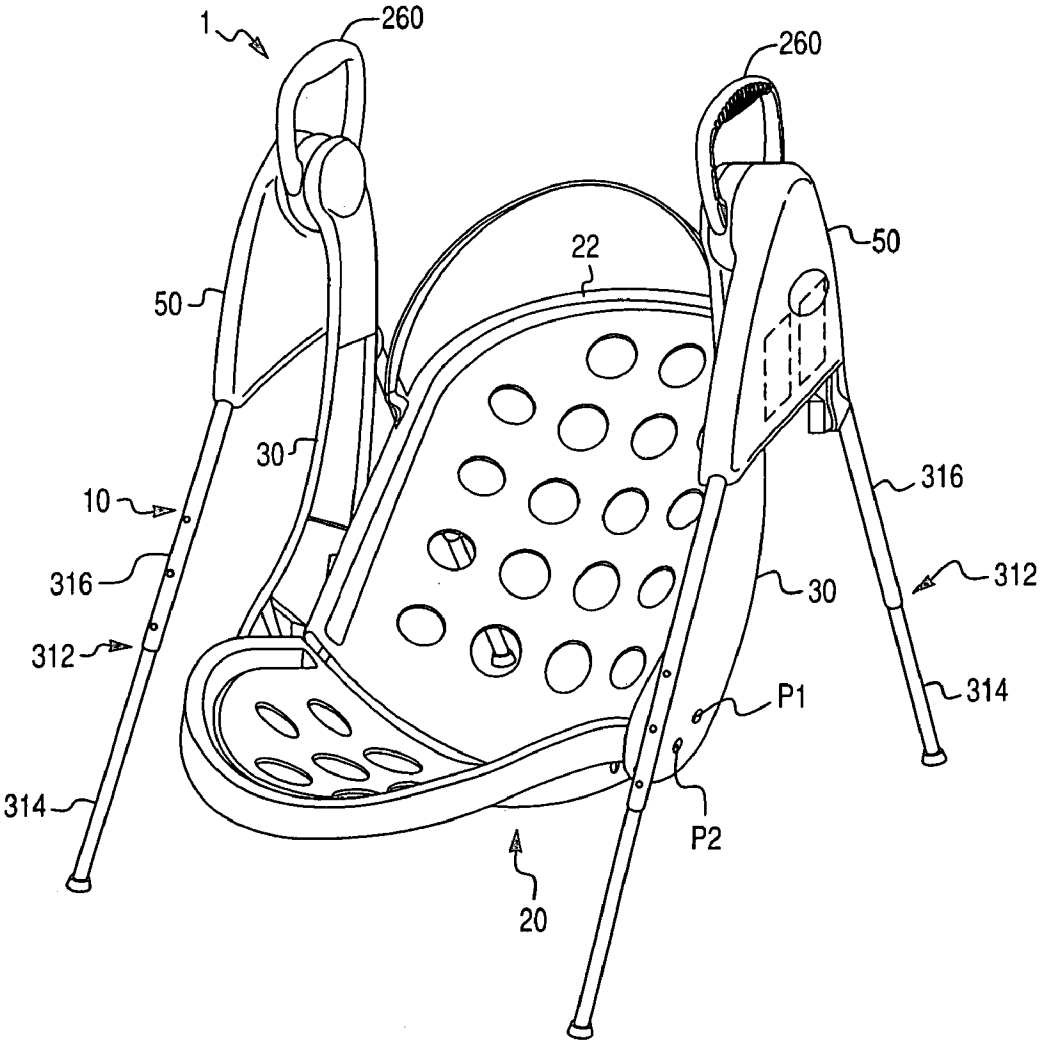
FIG. 30 is a front perspective view of the swing with adjustable length legs according to an embodiment of the invention.

The length of the legs 312 may be adjusted by manually actuating the length adjustment mechanism. For example, a protrusion 324, when it is engaged with a corresponding hole 322, may be manually disengaged by pressing on the protrusion 324 with a finger, for example, to push it away from the hole 322. As the protrusion 324 is pushed away from the hole 322, the first portion 314 is slid relative to the second portion 316 to adjust the leg length. When the protrusion 324 reaches another desired hole 322 (or in the case of FIG. 29, the hole 322 reaches another desired protrusion 324), the protrusion 324 is biased into the desired hole 322. The protrusion 324 may be biased by the resilient material of the spring member 320, for example. As best seen in FIG. 29, the spring member 320 may be fixed to an inside surface of the first portion 314 of the leg, and the resilient material of the spring member 320 acts to bias the protrusion 324 through a hole in an outer wall 326 of the first portion 314 and also through a hole 322 of the second portion 316. When the spring member 320 biases the protrusion 324 into a hole 322, the protrusion 324 prevents the first portion 314 from sliding within the second portion 316.

As an alternative to manually disengaging the protrusion 324 with a finger to adjust the leg length, a lock actuator may be used. One example of a lock actuator is as follows. The lock actuator may comprise three portions that slide over the leg 312, where the three portions are a slider mounted to the leg 312, a non-rotatable hub coupled to the slider, and a rotatable hub coupled to the non-rotatable hub. The slider allows the lock actuator to be easily slid up and down the leg 312. The non-rotatable hub provides an interface between the slider and the rotatable hub. An actuator of the rotatable hub is biased out of alignment with any of the holes 322. To align the actuator of the rotatable hub with a hole 322, the hub may be manually rotated against the bias. The actuator of the rotatable hub may be a ramp, for example, that engages a protrusion 324 to push the protrusion out of engagement with a hole 322. The first portion 314 of the leg then may be slid relative to the second portion 316 to adjust the leg length. As another example, the actuator of the rotatable hub may be a button, for example, which may be depressed against a protrusion 324 to push the protrusion out of engagement with the hole 322.

The adjustable legs provide a number of advantages to the swing. For travel, the legs of the swing may be adjusted to their shortest length to make the swing easier to store or transport. Once the swing has been moved to a desired location, the legs of the swing may be lengthened so that the seat of the swing is elevated. The elevated seat makes it easier to remove a child from the swing or place a child in the swing. The elevated seat also raises the child above and away from curious pets or young siblings.

The preferred embodiments have been set forth herein for the purpose of illustration. This description, however, should not be deemed to be a limitation on the scope of the invention. Various modifications, adaptations, and alternatives may occur to one skilled in the art without departing from the claimed inventive concept. The true scope and spirit of the invention are indicated by the following claims.

What is claimed is:

1. A swing comprising:

a swing frame including first and second housings;

a seat;

first and second hanger arms that connect the seat to the swing frame; and first and second swing handles rotationally coupled to the first and second housings, respectively, and to the first and second hanger arms, respectively, such that each swing handle may rotate about a respective handle rotational axis between at least two positions, each of the swing handles having a hand grip portion.

2. The child swing according to claim 1, wherein the swing frame is an open top swing frame having first and second opposing handle support structures associated with the first and second housings, respectively, and wherein each of the swing handles is rotationally coupled to a respective one of the opposing handle support structures.

3. The child swing according to claim 2, wherein each of the swing handles comprises a support interface portion attached to the respective handle support structure.

4. The child swing according to claim 2, wherein one of each swing handle and each respective handle support structure includes a protrusion, and the other of each swing handle and each respective handle support structure includes a recess to receive the protrusion such that, when each swing handle is at the first position and the protrusion is not within the recess, each swing handle is free to rotate relative to the respective handle support structure.

5. The swing of claim 1, wherein the swing frame includes first and second legs, wherein the first and second legs are pivotally connected to the first and second housings, respectively.

6. The child swing according to claim 5, wherein the swing frame further includes a leg fold mechanism that pivotally connects the first and second legs to the first and second housings, respectively.

7. The swing of claim 1, wherein the at least two positions includes a first position and a second position, the first position being substantially rotated about 180° relative to the second position.

8. The child swing according to claim 7, wherein the first position is a top position and the second position is a bottom position, the top position being substantially directly above the bottom position.

9. The swing according to claim 1, wherein the swing frame includes first and second legs, each of the first and second legs including a length adjustment mechanism that allows the respective leg to be adjustable in length.

10. A swing according to claim 9, wherein the first and second legs are first and second rear legs, and wherein the swing frame further comprises first and second front legs, each of the first and second front legs including a length adjustment mechanism that allows the respective leg to be adjustable in length.

11. A swing according to claim 9, wherein each leg includes a first portion and a second portion, the first portion configured to slide within the second portion to thereby adjust the length of the leg; and wherein the length adjustment mechanism comprises a biased protrusion on the first portion and multiple holes on the second portion sized to receive the protrusion.

12. A swing according to claim 9, wherein each leg includes a first portion and a second portion, the first portion configured to slide within the second portion to thereby adjust the length of the leg; and wherein the length adjustment mechanism comprises multiple biased protrusions on the first portion and a hole on the second portion sized to receive the protrusions.

13. A swing comprising:

a swing frame; and two swing handles rotationally coupled to the swing frame such that each swing handle may rotate about a respective handle rotational axis between at least two positions, each of the swing handles having a hand grip portion, wherein one of each swing handle and each respective handle support structure includes a protrusion, and the other of each swing handle and each respective handle support structure includes a recess matched to the protrusion such that, when the protrusion is within the recess, the swing handle is locked to prevent rotation relative to the respective handle support structure.

14. A swing comprising:

a swing frame; and at least one handle rotationally coupled to the swing frame such that the at least one handle may rotate about a handle rotational axis between at least two positions, the at least two positions including a first position and a second position, the first position being substantially rotated about 180° relative to the second position, wherein the swing frame comprises at least one handle support structure, the swing handle being rotationally coupled to the frame at the handle support structure, and wherein one of the swing handle and the handle support structure includes a protrusion, and the other of the swing handle and the handle support structure includes a recess to receive the protrusion such that, when the swing handle is at the first position and the protrusion is within the recess, the swing handle is locked to prevent rotation relative to the handle support structure.

15. A swing comprising:

a swing frame; and at least one handle rotationally coupled to the swing frame such that the at least one handle may rotate about a handle rotational axis between at least two positions, the at least two positions including a first position and a second position, the first position being substantially rotated about 180° relative to the second position, wherein the swing frame comprises at least one handle support structure, the swing handle being rotationally coupled to the frame at the handle support structure, and wherein one of the swing handle and the handle support structure includes a protrusion, and the other of the swing handle and the handle support structure includes a recess to receive the protrusion such that, when the swing handle is at the first position and the protrusion is not within the recess, the swing handle is free to rotate relative to the handle support structure.

* * * * *